US011136720B2

(12) United States Patent
Eckl et al.

(10) Patent No.: US 11,136,720 B2
(45) Date of Patent: Oct. 5, 2021

(54) MOISTURE-PROOF, FIBROUS SUBSTRATE HAVING ADJUSTABLE MOISTURE AND WET STRENGTH, AND METHOD FOR PRODUCTION THEREOF

(71) Applicant: CHEM&P GMBH & CO. KG, Schwaig (DE)

(72) Inventors: Josef Eckl, Augsburg (DE); Hans Senger, Bergkirchen (DE); Herbert Beck, Schwaig (DE)

(73) Assignee: CHEM&P GMBH & CO. KG, Schwaig (DE)

( * ) Notice: Subject to any disclaimer, the term of this patent is extended or adjusted under 35 U.S.C. 154(b) by 76 days.

(21) Appl. No.: 16/465,495

(22) PCT Filed: Nov. 16, 2017

(86) PCT No.: PCT/EP2017/079386
§ 371 (c)(1),
(2) Date: May 30, 2019

(87) PCT Pub. No.: WO2018/099724
PCT Pub. Date: Jun. 7, 2018

(65) Prior Publication Data

US 2020/0063369 A1 Feb. 27, 2020

(30) Foreign Application Priority Data

Nov. 30, 2016 (EP) ..... 16201550

(51) Int. Cl.

| | |
|---|---|
| ***D21H 17/07*** | (2006.01) |
| ***D21H 17/14*** | (2006.01) |
| *D21H 17/25* | (2006.01) |
| *D21H 17/28* | (2006.01) |
| *D21H 17/32* | (2006.01) |
| *D21H 21/22* | (2006.01) |

(52) U.S. Cl.
CPC ..... *D21H 17/07* (2013.01); *D21H 17/14* (2013.01); *D21H 17/25* (2013.01); *D21H 17/28* (2013.01); *D21H 17/32* (2013.01); *D21H 21/22* (2013.01)

(58) Field of Classification Search
None
See application file for complete search history.

(56) References Cited

U.S. PATENT DOCUMENTS

| | | | | |
|---|---|---|---|---|
| 4,755,421 A | | 7/1988 | Manning et al. | |
| 4,830,716 A | | 5/1989 | Ashmead | |
| 5,281,306 A | * | 1/1994 | Kakiuchi | C11D 17/041 162/158 |
| 5,629,081 A | | 5/1997 | Richards et al. | |
| 5,631,031 A | | 5/1997 | Meade | |
| 5,667,635 A | | 9/1997 | Win et al. | |
| 6,228,218 B1 | * | 5/2001 | Takeuchi | C11D 17/049 162/158 |
| 6,270,878 B1 | * | 8/2001 | Wegele | D21H 27/40 428/195.1 |
| 6,547,927 B1 | * | 4/2003 | Takeuchi | D21H 17/26 162/115 |
| 6,808,598 B1 | * | 10/2004 | Takeuchi | C11D 17/049 162/115 |
| 2006/0037724 A1 | * | 2/2006 | Akai | D21H 17/36 162/117 |
| 2009/0104430 A1 | * | 4/2009 | Cordial | D21H 23/22 428/322.7 |

FOREIGN PATENT DOCUMENTS

| | | | |
|---|---|---|---|
| DE | 2817604 | A1 | 10/1979 |
| DE | 60026460 | T2 | 10/2006 |
| EP | 0372388 | A2 | 6/1990 |
| EP | 0926299 | A2 | 6/1999 |
| EP | 1630288 | A1 | 3/2006 |
| EP | 2785914 | A1 | 10/2014 |
| JP | H02149237 | A | 6/1990 |
| JP | H09154764 | A | 6/1997 |
| JP | H10273892 | A | 10/1998 |
| JP | H11187983 | A | 7/1999 |
| JP | 2001115368 | A | 4/2001 |
| JP | 2001279596 | A | 10/2001 |
| JP | 2006081883 | A | 3/2006 |
| JP | 2010285719 | A | 12/2010 |
| JP | 2013204173 | A | 10/2013 |
| WO | 2013081911 | A1 | 6/2013 |

* cited by examiner

*Primary Examiner* — Dennis R Cordray
(74) *Attorney, Agent, or Firm* — Rimôn, P.C.

(57) ABSTRACT

The present invention relates to a wet strength, fibre-containing substrate having adjustable wet strength and wetness strength, wherein the substrate comprises fibres, at least one binder, at least one amphoteric amine and at least one moistening agent, wherein the at least one binder comprises or consists of at least one polysaccharide having at least one acid group-containing residue, and wherein the at least 1 moistening agent comprises at least 1 organic component selected from the group consisting of aliphatic alcohols, aliphatic ethers, aliphatic esters, monosaccharides, oligosaccharides and mixtures thereof, preferably aliphatic alcohols, aliphatic ethers and mixtures thereof, and also, furthermore, to a method for producing the wet strength, fibre-containing substrate, and to use thereof.

16 Claims, No Drawings

MOISTURE-PROOF, FIBROUS SUBSTRATE HAVING ADJUSTABLE MOISTURE AND WET STRENGTH, AND METHOD FOR PRODUCTION THEREOF

CROSS-REFERENCE TO RELATED APPLICATIONS

This application is a United States national stage entry of an International Application serial no. PCT/EP2017/079386 filed Nov. 16, 2017, which claims priority to European Patent Application serial no. 16201550.7 filed Nov. 30, 2016. The contents of these applications are incorporated herein by reference in their entirety as if set forth verbatim.

The present invention relates to a wet strength, fibre-containing substrate, wherein the substrate comprises fibres, at least one binder, at least one moistening agent and at least one amphoteric amine, wherein the at least one binder comprises or consists of at least one polysaccharide having at least one acid group-containing residue, and also, furthermore, to a method for producing the fibre-containing substrate, and to use thereof.

Pre-moistened toilet paper or skin cleansing wipes, wet wipes for short, have long been known in the prior art and may be produced from nonwoven products, paper products or tissue products treated in such a way that, disadvantageously, they have a high wetness strength. After being introduced into water, such as into the toilet water, therefore, unlike dry toilet paper, these products have a relatively long persistence. The high wetness strength means that wet wipes, after introduction into water, generally exhibit inadequate disintegration or none at all, and consequently they may contribute to the development of pipe blockages, and in the water treatment plant have to be separated off before the water is actually cleaned.

There are numerous approaches known from the prior art towards increasing the disintegrability of pre-moistened fibre wipes after introduction into water.

U.S. Pat. No. 5,629,081 describes a disintegrable wet wipe pre-moistened with a solution of 0.1-0.9% by weight of boric acid and 5-8% by weight of an alkali metal bicarbonate, the fibres therein being bonded by a binder comprising polyvinyl alcohol. Disadvantageously, the manufacture of this product is very costly and inconvenient and is toxicologically objectionable.

U.S. Pat. No. 4,755,421 discloses a nonwoven fibre web produced by water jet needling of cellulose fibres and regenerated cellulose fibres, this web being said to be broken up in the waste water by stirring or prolonged residence. Disadvantageously, however, the fibre web also has excessively high mechanical persistence when disposed of.

A further method for producing a water-disintegrable wipe is described in U.S. Pat. No. 5,667,635, wherein three plies of tissue paper are connected to one another by embossing only at the corners and the two outer plies are said to boost disintegration of the wipe in the aqueous system as a result of additional local application of a wet strength agent. Disadvantageously, the manufacture of this product is very costly and inconvenient and the product takes some considerable time to disintegrate after having been introduced into water.

DE 28 17 604 C2 discloses a pre-moistened, flushable wipe which consists of a nonwoven fibre material web and of an adhesive binder which is distributed within the web and which binds the fibre web material of the web, the adhesive binder consisting substantially of an acid-insoluble/alkali-soluble acidic polymer, which is said to be resistant to weakening of the bond between the fibres of the web in an acidic fluid.

A disadvantage in this case, however, is that disintegration of this wipe occurs even before its intended use, thereby being detrimental to its further usefulness.

EP 0 372 388 A2 describes a water-disintegrable cleansing wipe which comprises a fabric woven from water-dispersible fibres, said fabric incorporating a water-soluble binder having a carboxyl group, at least one metal ion selected from the group of ions of the alkaline earth metals, manganese, zinc, cobalt and nickel, and an aqueous cleansing composition comprising an organic solvent.

A disadvantage in this case, however, is that the wetness strength of the water-disintegrable cleansing wipe is high, meaning that a cleansing wipe measuring 50 mm×50 mm must be stirred with a high input of mechanical energy (at 300 rpm, over 90 s in 500 ml of water) in order to disintegrate.

EP 2 785 914 A1 is directed to a nonwoven fibre web which is disintegrable in water and comprises fibres bonded by a water-soluble cellulose ether having a viscosity of up to 500 mPas·s, measured as a 2% by weight strength solution in water at 20° C. using a Haake VT550 visco tester with a cylinder system, MV measuring cup, at 2.55 $s^{-1}$.

A disadvantage in this case, however, is that the water-disintegrable nonwoven fibre web does not have any wet strength.

The known, commercially available, water-disintegrable wet wipes have the disadvantage, on the one hand, that they include substances which are in some cases aggressive, problematic in terms of food law, or even allergenic and pro-inflammatory, in order to achieve sufficient mechanical wet strength. On the other hand, however, the wet strength is in some cases lowered to the point where, disadvantageously, the integrity of the wet wipe is destroyed by just minor mechanical loading, of the kind which may occur during service, for example.

It is an object of the present invention, therefore, to provide a wet strength, fibre-containing substrate which on the one hand, in application, exhibits a sufficient mechanical wet strength and on the other hand, after introduction in water, exhibits a sufficient disintegration capacity, i.e. low wetness strength, so that there are no blockages of the toilet pipe, for example, and/or there is no need for it to be removed in the water treatment plant ahead of the actual cleaning of the waste water.

It is a further object of the present invention to provide a wet strength, fibre-containing substrate which is simple and inexpensive to manufacture.

The object is achieved through the provision of a wet strength, fibre-containing substrate according to claim 1, where the substrate comprises fibres, at least 1 binder, at least 1 amphoteric amine and at least 1 moistening agent, wherein the at least 1 binder comprises at least 1 polysaccharide having at least 1 acid group-containing residue and wherein the at least 1 moistening agent comprises at least 1 organic component selected from the group consisting of aliphatic alcohols, aliphatic ethers, aliphatic esters, monosaccharides, oligosaccharides and mixtures thereof, preferably aliphatic alcohols, aliphatic ethers and mixtures thereof.

The substrate preferably comprises fibres, at least one, preferably water-soluble, binder, at least one, preferably water-soluble, amphoteric amine and at least one, preferably liquid, moistening agent, wherein the at least one, preferably water-soluble, binder comprises or consists of at least one, preferably water-soluble, polysaccharide and wherein the at least one, preferably water-soluble, polysaccharide has at least one acid group-containing residue, more preferably carboxyl group-containing residue, and is selected more preferably from the group consisting of carboxymethyl cellulose (CMC), carboxymethyl starch (CMS) and mixtures thereof, more preferably carboxymethyl cellulose, wherein the at least one, preferably water-soluble, amphoteric amine is at least one, preferably water-soluble, aminocarboxylic acid, more preferably alpha-aminocarboxylic acid, which is preferably selected from the group consisting of alanine, arginine, asparagine, aspartic acid, citrulline, cysteine, S-methylcysteine, cystine, creatine, homocysteine, homoserine, norleucine, 2-aminobutanoic acid, 2-amino-3-mercapto-3-methylbutanoic acid, 3-aminobutanoic acid, 2-amino-3,3-dimethylbutanoic acid, 4-aminobutanoic acid, 2-amino-2-methylpropanoic acid, 2-amino-3-cyclohexylpropanoic acid, 3-aminopropanoic acid, 2,3-diaminopropanoic acid, 3-aminohexanoic acid, gamma-carboxyglutamic acid (3-aminopropane-1,1,3-tricarboxylic acid), glutamine, glutamic acid, glycine, histidine, hydroxyproline, p-hydroxyphenylglycine, isoleucine, isovaline, leucine, lysine, methionine, ornithine ((S)-(+)-2,5-diaminopentanoic acid), phenylalanine, proline, serine, threonine, tryptophan, tyrosine, valine, salts thereof, complexes thereof and mixtures thereof, preferably of alanine, arginine, glycine, proline, lysine, histidine, glutamine, glutamic acid, aspartic acid, ornithine, salts thereof, complexes thereof and mixtures thereof, more preferably of alanine, arginine, glycine, proline, lysine, ornithine, salts thereof, complexes thereof and mixtures thereof, more preferably arginine, lysine, ornithine, salts thereof, complexes thereof and mixtures thereof, more preferably alanine, glycine, proline, salts thereof, complexes thereof and mixtures thereof, more preferably histidine, glutamine, glutamic acid, aspartic acid, salts thereof, complexes thereof and mixtures thereof, and wherein the at least one, preferably liquid, moistening agent comprises at least one organic component selected from the group consisting of aliphatic alcohols, aliphatic ethers, aliphatic esters, monosaccharides, oligosaccharides and mixtures thereof, preferably aliphatic alcohols, aliphatic ethers and mixtures thereof, more preferably ethanol, 1-propanol, 2-propanol, ethane-1,2-diol, propane-1,2-diol, propane-1,3-diol, 1,2,3-propanetriol and mixtures thereof, more preferably ethanol, 1-propanol, 2-propanol, ethane-1,2-diol, propane-1,2-diol, propan-1,3-diol and mixtures thereof, and optionally further comprises at least one polyvalent metal cation, more preferably $Ca^{2+}$, $Zn^{2+}$ and mixtures thereof, more preferably $Ca^{2+}$.

According to one preferred embodiment of the invention, the wet strength and wetness strength of the wet strength, fibre-containing substrate is controllable. Expressed alternatively, the disintegrability of the fibre-containing substrate of the invention is controllable.

The object is further achieved by the provision of a method according to claim 14 for producing a wet strength, fibre-containing substrate according to any of claims 1 to 13, wherein the method comprises the following step:

(a) providing a fibre-containing substrate comprising fibres and at least 1 binder, wherein the at least 1 binder comprises at least 1 polysaccharide having at least 1 acid group-containing residue, characterized in that furthermore, in and/or after step (a), at least 1 amphoteric amine, and at least 1 moistening agent are added successively, together or simultaneously, wherein the at least 1 moistening agent comprises at least 1 organic component selected from the group consisting of aliphatic alcohols, aliphatic ethers, aliphatic esters, monosaccharides, oligosaccharides and mixtures thereof, preferably aliphatic alcohols, aliphatic ethers and mixtures thereof.

Furthermore, the object is achieved through the use of a wet strength, fibre-containing substrate according to claim 15 as a hygiene article, in particular as wet wipe, moist toilet paper, baby nappy, care wipe or cleansing wipe, or as seed carrier, cultivating pot or plant bag.

Preferred embodiments of the invention are specified in the dependent claims.

The term "binder" is understood in accordance with the invention to refer to a polymeric substance which comprises or consists of at least one, preferably water-soluble, polysaccharide having at least one acid group-containing residue, more preferably carboxyl group-containing residue, and which is capable of joining fibres of the substrate of the invention to one another.

For example, following application to fibres of the substrate of the invention, the at least one binder is able to remain adhering to the fibres by physical drying and to join these fibres to one another by adhesion and/or cohesion.

The at least one, preferably water-soluble, binder which comprises or consists of at least one, preferably water-soluble, polysaccharide, the polysaccharide having at least one acid group-containing residue, may comprise different binders, for example 2, 3, 4 or more, preferably water-soluble, binders.

By way of example, different binders may each comprise or consist of different, preferably water-soluble, polysaccharides, wherein the at least one acid group-containing residue may be in each case the same or different from one another. By way of example, the number of acid group-containing residues per molecule in the respective polysaccharide and/or the structure thereof may be in each case identical or different from one another.

Alternatively, different binders may comprise or consist of the same, preferably water-soluble, polysaccharide, in which case the binders may differ, for example, respectively in the number of the acid group-containing residues which are bonded to a molecule of the respective polysaccharide, and/or in the structure thereof.

The term "amphoteric amine" is understood in accordance with the invention to refer to a compound, preferably an organic compound, which may be both an acceptor and a donor of protons, i.e. which may react both as Brønsted acid and as Brønsted base. An amphoteric amine in the sense of the invention has preferably at least 1 protonatable and/or protonated amino group and, furthermore, at least 1 deprotonatable and/or deprotonated acid group, more preferably carboxyl group. The at least one, preferably water-soluble, amphoteric amine may comprise different amphoteric amines, for example 2, 3, 4 or more, preferably water-soluble, amphoteric amines. An amphoteric amine is preferably an amino carboxylic acid and/or a salt and/or a complex thereof, more preferably an alpha-amino acid and/or a salt and/or a complex thereof. A salt of an amphoteric amine, preferably aminocarboxylic acid, more preferably alpha-aminocarboxylic acid, is more preferably a salt of a polyvalent metal cation, more preferably $Ca^{2+}$, $Zn^{2+}$ and mixtures thereof, more preferably $Ca^{2+}$. A complex of an amphoteric amine, preferably aminocarboxylic acid, more preferably alpha-aminocarboxylic acid, is more preferably a complex of a polyvalent metal cation, more preferably $Ca^{2+}$, $Zn^{2+}$ and mixtures thereof, more preferably $Ca^{2+}$.

The term "moistening agent" is understood in accordance with the invention to refer to a substance or a composition which modifies the swelling properties of the at least 1 binder in water, and preferably modifies the swelling of the at least 1 binder in the presence of water contained in the moistening agent.

In accordance with the invention, the at least 1 moistening agent comprises at least 1 organic component selected from the group consisting of aliphatic alcohols, aliphatic ethers, aliphatic esters, monosaccharides, oligosaccharides and mixtures thereof, preferably aliphatic alcohols, aliphatic ethers and mixtures thereof.

The at least one moistening agent preferably also prevents the substrate of the invention from drying out, by, for example, binding water and/or preventing evaporation of water and/or binding atmospheric moisture to itself during the storage of the substrate of the invention.

In one preferred embodiment of the present invention, the substrate of the invention is solvent-containing, preferably moist. More preferably the substrate of the invention has a solvent content, preferably a content of liquid constituents, in a range of 50% by weight to 450% by weight, more preferably of 90% by weight to 390% by weight, more preferably of 110% by weight to 340% by weight, more preferably of 150% by weight to 310% by weight, more preferably of 160% by weight to 200% by weight, more preferably of 230% by weight to 280% by weight, based in each case on the total weight of the substrate of the invention in the dry state.

The inventors have found that surprisingly, by using at least one, preferably water-soluble, binder which comprises or consists of at least one, preferably water-soluble, polysaccharide, the polysaccharide having at least one acid group-containing residue, at least one, preferably water-soluble, amphoteric amine and at least one moistening agent, the at least one moistening agent comprising at least one organic component selected from the group consisting of aliphatic alcohols, aliphatic ethers, aliphatic esters, monosaccharides, oligosaccharides and mixtures thereof, preferably aliphatic alcohols, aliphatic ethers and mixtures thereof, it is possible to provide a wet strength, fibre-containing substrate which on the one hand exhibits sufficient mechanical wet strength and does not lose its integrity under short-term mechanical loading, by rubbing on the skin, for example. On the other hand, after introduction in water, the wet strength, fibre-containing substrate of the invention possesses sufficient disintegrability, i.e. low wetness strength, in water, and so, for example, after disposal by way of the toilet, blockages in the waste water pipe are avoided, or the substrate of the invention does not have to be removed in the water treatment plant before the waste water is actually cleaned. Furthermore, even after prolonged storage, the wet strength, fibre-containing substrate of the invention exhibits sufficient mechanical stability.

The term "wet strength" is understood in the sense of the invention to refer to the strength of a substrate of the invention in the presence of an aqueous fluid comprising at least one organic component, wherein the at least one organic component is selected from the group consisting of aliphatic alcohols, aliphatic ethers, aliphatic esters, monosaccharides, oligosaccharides and mixtures thereof, preferably aliphatic alcohols, aliphatic ethers and mixtures thereof. The "wet strength" may be determined preferably by means of a strip tensile test in analogy to DIN EN ISO 13934-1 (1999-04), where preferably the moist substrate is measured directly.

A wet strength, fibre-containing substrate of the invention preferably exhibits a wet strength as determined by means of a strip tensile test in accordance with DIN EN ISO 13934, Part 1 (date of issue: 1999-04) at 20° C. and a relative humidity of 65%, of more than 3 N, preferably in a range of 3 N to 250 N, more preferably in a range of 4 N to 150 N, more preferably in a range of 4.5 N to 120 N, more preferably in a range of 5 N to 80 N, more preferably in a range of 6 N to 55 N.

The inventors have found that the wet strength of a substrate of the invention can be adjusted by varying the amounts of the constituents present in the substrate within the limit values specified below for the respective constituents. The wet strength of a substrate of the invention may preferably be tailored to the particular use of a substrate of the invention.

When configured as a moist toilet paper, for example, a wet strength, fibre-containing substrate of the invention has a wet strength, determined by means of a strip tensile test according to DIN EN ISO 13934, Part 1 (date of issue: 1999-04) at 20° C. and a relative humidity of 65%, in a range of 8 N to 14 N, preferably in a range of 10 N to 12 N.

A wet strength of less than 8 N, for example, leads to inadequate mechanical stability in the context of use as moist toilet paper. A wet strength of more than 14 N, in contrast, produces excessively stiff and/or firm tactility in use when configured as moist toilet paper.

Furthermore, for example, the wet strength can be increased if for an intended use of a substrate of the invention, increased mechanical stability is necessary or if tactile qualities of a substrate of the invention, examples being fluffiness, softness and/or grip, are of minor importance.

The inventors have determined that in spite of increase in the wet strength of a substrate of the invention, the substrate after introduction into water still disintegrates preferably completely. Following the disintegration there are preferably only fibres present.

The term "wetness strength" is understood preferably to refer to the strength of a substrate of the invention in the presence of an excess of water. The wetness strength of a substrate of the invention may be ascertained preferably by means of a wet tensile test according to DIN EN ISO 12625, Part 5 (date of issue: 2005-09) "Determination of wet tensile strength".

A wet strength, fibre-containing substrate of the invention preferably has a wetness strength as determined by wet tensile testing according to DIN EN ISO12625, Part 5 (date of issue: 2005-09) at 20° C. and a relative atmospheric humidity of 65% of not more than 2 N, more preferably of not more than 1 N, preferably of not more than 0.5 N.

A substrate of the invention which has a wet strength, determined as specified above, of more than 3 N, preferably in a range of 3 N to 250 N, more preferably in a range of 6 N to 210 N, more preferably in a range of 4 N to 150 N, more preferably in a range of 4.5 N to 120 N, more preferably in a range of 5 N to 80 N, more preferably in a range of 6 N to 55 N, preferably, after introduction in water, continues preferably to be fully disintegrable, and more preferably the wetness strength, determined as specified above, of the substrate is not more than 2 N, preferably not more than 1 N, more preferably not more than 0.5 N.

Preferably, after introduction into water, a substrate of the invention undergoes complete disintegration within less than 1 h, preferably in a period of less than 15 min, preferably in a period of less than 1 min, preferably in a period of less than 30 s, more preferably in a period of 10 s to less than 1 h, more preferably in a period of 30 s to less than 30 min, more preferably in a period of 1 min to less than 15 min. After the disintegration, there are preferably only fibres present.

In accordance with the invention, besides fibres, the wet strength, fibre-containing substrate comprises at least one, preferably water-soluble, binder which comprises or consists of at least one, preferably water-soluble, polysaccharide, at least one, preferably water-soluble, amphoteric amine and at least one moistening agent, the preferably water-soluble polysaccharide having at least one acid group-containing residue.

The at least one amphoteric amine preferably, together with the at least one binder, forms at least one poly salt and/or polymeric assembly which, together with the at least one moistening agent, is substantially non-soluble and/or non-dispersible.

The term "poly salt" is understood in accordance with the invention to refer to a polymeric substance which comprises or consists of at least one, preferably water-soluble, polysaccharide having at least one ionically dissociated, acid group-containing residue, more preferably carboxyl group-containing residue, which forms a bond, preferably an ionic bond, with a group of opposite charge.

An ionically dissociated group bonded to the polysaccharide is preferably an anionically charged group, preferably deprotonated acid group, more preferably carboxylate group.

In the formation of a poly salt, preferably, anionically charged functional groups of the at least one binder, for example deprotonated acid groups of the at least one acid group-containing residue, and cationically charged functional groups of the at least one amphoteric amine, for example protonated amino groups, are able to bind to one another, for example by ionic interaction of residues of opposite charge, thereby preferably restricting or eliminating the solubility in the presence of the at least one moistening agent.

Through use of at least one, preferably water-soluble, amphoteric amine and of the at least one moistening agent together with at least one, preferably water-soluble, binder, therefore, the wet strength of a fibre-containing substrate of the invention is increased, under mechanical loading, for example.

After the fibre-containing substrate has been introduced into water—for example, mains water, grey water or waste water—the at least one moistening agent which comprises the at least one organic component is preferably diluted and/or dissolved in water. As a result, water is able to attach to the at least one, preferably water-soluble, binder, and/or the at least one, preferably water-soluble, binder is able to take up water, thereby allowing the at least one, preferably water-soluble, binder to swell in each case. As a result, preferably, the binding capacity of the binder is reduced or eliminated.

For example, after introduction of the substrate of the invention into water with a neutral or alkaline pH, there may also be partial, preferably complete, dissolution of the poly salt. This may result in an increase in the water-solubility and/or water-dispersibility of the at least one binder, thereby weakening or destroying the structural integrity of the substrate of the invention.

By this means, fibre structures and/or connections between the fibres within the substrate of the invention may be expanded, loosened, weakened, extended and/or destroyed. Through mechanical influences, as for example through the flow influences which occur in waste water, the structural integrity of the substrate of the invention is further weakened, preferably destroyed.

As a general rule, the pH of waste water is in a range from 7.0 to 8.5.

Following the application and setting of the at least one binder on a fibre-containing substrate, the fibres of the binder-containing, fibre-containing substrate are joined to one another at least partly, preferably completely, by the at least one binder. After the at least one amphoteric amine has been applied to the binder-containing, fibre-containing substrate, the at least one binder and the at least one amphoteric amine are present preferably partly, more preferably completely, in the form of poly salt and/or of polymeric aggregate.

Alternatively, the at least one amphoteric amine may be applied together with the at least one binder to a fibre-containing substrate, in which case the at least one binder and the at least one amphoteric amine likewise are present preferably partly, more preferably completely, in the form of poly salt and/or of polymeric aggregate.

After application of the at least one moistening agent, comprising the aforesaid at least one organic component, to a fibre-containing substrate, the result is a substrate of the invention. The at least one moistening agent may be applied, for example, together with the at least one amphoteric amine, by means for example of separate application of the at least one moistening agent and of the at least one amphoteric amine, and/or by application of a mixture which comprises the at least one moistening agent and the at least one amphoteric amine.

When the substrate of the invention is introduced into water having preferably a pH of greater than or equal to 7.0, the at least one moistening agent, which comprises the aforesaid at least one organic component, is preferably diluted or dissolved in water, so that the substrate disintegrates down to fibre size. With preference there are only fibres still present after the disintegration.

In this case, water may attach to the at least one binder and/or to the at least one amphoteric amine, in which case preferably the poly salt and/or the polymeric aggregate undergoes partial, more preferably complete, dissolution. As a result of partial, more preferably complete, dissolution of the poly salt and/of the polymeric aggregate, the contact between the at least one amphoteric amine and the at least one binder may be at least partly, preferably completely, interrupted.

As a result of interruption of the contact—by dissolution of the poly salt and/or of the polymeric aggregate, for example—between the at least one binder and the at least one amphoteric amine, the attachment of water to the at least one binder may be facilitated and/or the water-solubility of the at least one binder may be increased.

The at least one binder may be joined to fibres of the substrate of the invention by way, for example, of hydrogen bonds.

When the substrate of the invention is introduced into water having preferably a pH of greater than or equal to 7.0, hydrogen bonds may be undone and the bonds between the at least one binder and fibres of the substrate of the invention are at least partly, preferably completely, parted, as a result of which the at least one binder is able to detach, for example, from the fibres.

The pH values stated in the present specification are preferably measured in water under standard conditions (25° C., 1013 mbar).

A binder used in accordance with the invention comprises or consists of at least one, preferably water-soluble, polysaccharide having at least one acid group-containing residue.

The term "polysaccharide" is understood in the sense of the invention to refer to homopolysaccharides, heteropolysaccharides and mixtures thereof, which may preferably consist of identical or different monosaccharides and may have a linear or branched molecular construction.

For industrial use, high-molecular-mass polysaccharide biopolymers may be partially degraded and/or functionalized preferably by thermomechanical and/or chemical and/or enzymatic modification. The partially degraded and/or converted polysaccharides resulting from the treatment preferably become more soluble in water, the solutions become more stable, and/or the coatings or surface films formed from them develop greater strength and binding power.

A solution of a polysaccharide may preferably be adjusted in its dynamic viscosity, by thermomechanical and/or chemical and/or enzymatic modification of the polysaccharide, in such a way that the solution can be used without problems in corresponding application operations.

In one preferred embodiment, a 2% by weight solution, based on the total weight of the solution, of the at least one, preferably water-soluble, polysaccharide having at least one acid group-containing residue has a dynamic viscosity in water at 20° C. in a range of 1 mPa·s to 10 000 mPa·s, preferably in a range of 50 mPa·s to 3000 mPa·s, more preferably in a range of 550 mPa·s to 2500 mPa·s, preferably determined by means of a Searle rotary viscometer of type Haake®Viscotester®550 (Thermo Fisher Scientific Inc., Karlsruhe, Del.) with cylinder measuring facility, MV measuring cup, at a rotational speed of 2.55 $s^{-1}$.

Depending on the nature of the modification and of the composition of a polysaccharide, solutions of a modified polysaccharide may preferably have a different dispersity, preferably polydispersity.

For example, solutions of a modified polysaccharide may have a varying molar mass composition, which preferably enables the dynamic viscosity of the solution to be tailored to the application system used, by virtue of an adjustable viscoelasticity and/or structural viscosity of the solution, for example. For example, a solution of a modified polysaccharide may include polysaccharide molecules each constructed, for example, from a different number of monosaccharides joined to one another via a glycosidic bond. Moreover, a solution of a modified polysaccharide may comprise monosaccharides and/or oligosaccharides.

An oligosaccharide preferably has 2 to 9 identical or different monosaccharides, each joined to one another via a glycosidic bond.

The at least one, preferably water-soluble, polysaccharide having at least one acid group-containing residue preferably has at least 10, preferably at least 50, identical or mutually different monosaccharides, each joined to one another via a glycosidic bond. The at least one, preferably water-soluble, polysaccharide having at least one acid group-containing residue preferably has on average about 10 to 20 000, preferably 110 to 2000, identical or different monosaccharides, each joined to one another via a glycosidic bond.

Suitable polysaccharides may be branched or unbranched, preferably unbranched.

In one preferred embodiment the at least one, preferably water-soluble, polysaccharide is cellulose, hemicellulose, starch, agarose, algin, alginate, chitin, pectin, gum arabic, xanthan, guaran or a mixture thereof, preferably cellulose, hemicellulose, starch or a mixture thereof, preferably cellulose, hemicellulose, or a mixture thereof, more preferably cellulose.

Hemicellulose is in particular a collective term for naturally occurring mixtures of polysaccharides in variable constitution, which may be isolated from plant biomass, for example.

The polysaccharides of the hemicelluloses may be constructed from different monosaccharides. Monosaccharides frequently represented are preferably pentoses, as for example xylose and/or arabinose, hexoses, for example glucose, mannose and/or galactose, and also modified monosaccharides, such as sugar acids, preferably uronic acids, which are selected for example from the group of the hexuronic acids, such as glucuronic acid, methylglucuronic acid and/or galacturonic acid, for example, or deoxymonosaccharides, preferably deoxyhexoses, such as rhamnose, for example.

A deoxymonosaccharide is preferably a monosaccharide in which at least one OH group has been replaced by a hydrogen atom.

Cellulose is a polysaccharide, which is preferably unbranched. Cellulose preferably consists on average of around 50 to 1000 cellobiose units. Cellobiose is a disaccharide made up of two glucose molecules, which are linked β-1,4-glycosidically to one another.

A suitable cellulose preferably has on average around 100 to 20 000, preferably 110 to 2000, glucose molecules.

Starch is a polysaccharide made up of D-glucose units linked to one another via α-glycosidic bonds.

Starch in the sense of the invention likewise comprehends amylose, amylopectin and mixtures thereof, preferably amylose.

Amylose is an unbranched polysaccharide made up of D-glucose units which are linked only α-1,4-glycosidically.

Amylopectin is a branched polysaccharide made up of D-glucose units which are linked α-1,4-glycosidically. Around every 15-30 monomers there may be a side chain which is linked α-1,6-glycosidically and is made up of D-glucose units linked α-1,4-glycosidically. A side chain preferably has at least 5 glucose units which are linked α-1,4-glycosidically. More preferably a side chain has 7 to 60 glucose units, preferably 10 to 50 glucose units, preferably 12 to 30 glucose units, each linked α-1,4-glycosidically.

A polysaccharide used as binder in accordance with the invention has at least one acid group-containing residue, which is joined to the polysaccharide preferably through an ether group.

The at least one polysaccharide and the at least one acid group-containing residue therefore preferably form a polysaccharide ether, preferably by partial or complete substitution of the hydrogen atoms of the hydroxyl groups in the monosaccharide units of the at least one polysaccharide by acid group-containing residues, where the acid group-containing residues may be identical to or different from one another.

The term "acid group-containing residue" is understood in accordance with the invention to refer to organic residues which are able to enter into an equilibrium reaction with water or other protonatable solvents. The product in the case of water is preferably the oxonium ion $H_3O^+$, while the acid group-containing residue gives up a proton to the water solvent and forms an anionically charged function group, for example a carboxylate group.

The term "acid group-containing residue" is understood preferably to refer to carboxyl group-containing residues, phosphate-containing residues, phosphonic acid-containing residues, and combinations thereof, more preferably to carboxyl group-containing residues.

More preferably the at least one acid group-containing residue is at least one —O-alkylcarboxyl residue, at least one —O-alkylphosphate residue, at least one —O-alkylphosphonic acid residue or a combination thereof, preferably at least one —O-alkylcarboxyl residue, where in each case independently of one another the alkyl radical, which may be straight-chain or branched, has 1 to 4 carbon atoms, preferably 1 to 3 carbon atoms, preferably 1 to 2 carbon atoms, more preferably 1 carbon atom.

In one preferred embodiment of the invention, the at least one acid group-containing residue is a carboxyl group-containing residue, preferably an alkylcarboxyl residue, more preferably an —O-alkylcarboxyl residue, where in each case independently of one another the alkyl radical, which may be straight-chain or branched, has 1 to 4 carbon atoms, preferably 1 to 3 carbon atoms, preferably 1 to 2 carbons atoms, more preferably 1 carbon atom.

The at least one polysaccharide and the at least one acid group-containing residue, preferably —O-alkylcarboxyl residue, —O-alkylphosphate residue, —O-alkylphosphonic acid residue or a combination thereof, more preferably —O-alkylcarboxyl radical, preferably form a polysaccharide ether, preferably by partial or complete substitution of the hydrogen atoms of the hydroxyl groups in the monosaccharide units of the at least one polysaccharide by acid group-containing residues, preferably alkylcarboxyl residues, alkylphosphate residues, alkylphosphonic acid residues or a combination thereof, more preferably alkylcarboxyl residues, which in each case independently of one another may be identical or different from one another and where in each case the alkyl residue, which may be straight-chain or branched, has 1 to 4 carbon atoms, preferably 1 to 3 carbon atoms, preferably 1 to 2 carbon atoms, more preferably 1 carbon atom.

A polysaccharide used as binder in accordance with the invention preferably has an average degree of substitution (DS) by the aforementioned at least one acid group-containing residue, preferably the at least one carboxyl group-containing residue, preferably the at least one —O-alkylcarboxyl residue, where in each case the alkyl radical, which may be straight-chain or branched, has 1 to 4 carbon atoms, preferably 1 to 3 carbon atoms, preferably 1 to 2 carbon atoms, more preferably 1 carbon atom, in a range of more than 0.4 to 2.0, preferably in a range of 0.5 to 1.5, preferably in a range of 0.6 to 1.1, preferably in a range of 0.7 to 0.9.

The average degree of substitution (DS) pertains to the average number of acid group-containing residues, preferably carboxyl group-containing residues, preferably —O-alkylcarboxyl residues, where in each case the alkyl radical, which may be straight-chain or branched, has 1 to 4 carbon atoms, preferably 1 to 3 carbon atoms, preferably 1 to 2 carbon atoms, more preferably 1 carbon atom, which are bonded per monosaccharide unit, preferably through an ether bond.

Aforesaid acid group-containing residues, preferably carboxyl group-containing residues, preferably aforesaid —O-alkylcarboxyl residues, may preferably be identical to or different from one another.

If different acid group-containing residues, preferably carboxyl group-containing residues, preferably —O-alkylcarboxyl residues, are bonded to monosaccharide units, the average degree of substitution (DS) pertains to the average number of all aforesaid acid group-containing residues, preferably carboxyl group-containing residues, preferably —O-alkylcarboxyl residues, which are bonded in each case per mole of monosaccharide units, preferably through an ether bond.

Preferably, hereinafter, the average degree of substitution (DS) by the at least one acid group-containing residue, preferably the at least one carboxyl group-containing residue, preferably the at least one —O-alkylcarboxyl residue, is referred to as "average degree of substitution (DS)".

The average degree of substitution (DS) of the polysaccharide by acid group-containing residues, preferably carboxyl group-containing residues, preferably —O-alkylcarboxyl residues, may be determined, for example, in analogy to ASTM D 1439-03/method B, for the sodium salt of carboxymethylcellulose.

A suitable polysaccharide having at least one acid group-containing residue, preferably at least one carboxyl group-containing residue, preferably at least one of the aforesaid —O-alkylcarboxyl residues, may additionally have alkyl residues which in each case independently of one another may be straight-chain or branched and have 1 to 4 carbon atoms, preferably 1 to 3 carbon atoms, preferably 1 to 2 carbon atoms, more preferably 1 carbon atom, hydroxyalkyl radicals which in each case independently of one another may be straight-chain or branched and have 1 to 4 carbon atoms, particularly 1 to 3 carbon atoms, preferably 1 to 2 carbon atoms, more preferably 1 carbon atom, or a combination thereof, where the alkyl radicals and/or hydroxyalkyl radicals are preferably likewise bonded through an ether bond to monosaccharide units of the polysaccharide.

The at least one, preferably water-soluble, binder preferably comprises or consists of at least one, preferably water-soluble, polysaccharide which is selected from the group consisting of carboxyalkyl polysaccharides, carboxyalkyl alkyl polysaccharides, carboxyalkyl hydroxyalkyl polysaccharides, carboxyalkyl alkyl hydroxyalkyl polysaccharides and mixtures thereof, preferably carboxyalkyl polysaccharides, where aforesaid alkyl radicals each independently of one another may be straight-chain or branched and have 1 to 4 carbon atoms, preferably 1 to 3 carbon atoms, preferably 1 to 2 carbon atoms, more preferably 1 carbon atom.

The at least one, preferably water-soluble, binder preferably comprises or consists of at least one, preferably water-soluble, polysaccharide which is selected from the group consisting of carboxymethyl polysaccharides, carboxymethyl methyl polysaccharides, carboxymethyl hydroxymethyl polysaccharides, carboxymethyl methyl hydroxymethyl polysaccharides and mixtures thereof, preferably carboxymethyl polysaccharides.

In one preferred embodiment, the at least one, preferably water-soluble, binder comprises or consists of at least one, preferably water-soluble, polysaccharide which is selected from the group consisting of carboxyalkyl celluloses, carboxyalkyl alkyl celluloses, carboxyalkyl hydroxyalkyl celluloses and mixtures thereof, wherein aforesaid alkyl radicals may in each case independently of one another be straight-chain or branched and have 1 to 4 carbon atoms, preferably 1 to 3 carbon atoms, preferably 1 to 2 carbon atoms, more preferably 1 carbon atom.

The at least one, preferably water-soluble, binder more preferably comprises or consists of at least one, preferably water-soluble, polysaccharide which is selected from the group consisting of carboxymethyl cellulose (CMC), carboxymethyl starch (CMS), carboxyethyl cellulose (CEC), carboxypropyl cellulose, carboxymethyl methyl cellulose (CMMC), carboxymethyl ethyl cellulose, carboxymethyl propyl cellulose, carboxy ethyl methyl cellulose, carboxyethyl ethyl cellulose, carboxymethyl hydroxymethyl cellulose, carboxymethyl hydroxyethyl cellulose (CMHEC), carboxymethyl hydroxypropyl cellulose, carboxyethyl hydroxymethyl cellulose, carboxyethyl hydroxyethyl cellulose and mixtures thereof, more preferably carboxymethyl cellulose, carboxymethyl starch, carboxyethyl cellulose, carboxypropyl cellulose and mixtures thereof, more preferably carboxymethyl cellulose, carboxymethyl starch and mixtures thereof, more preferably carboxymethyl cellulose.

The at least one, preferably water-soluble, binder preferably comprises or is an alkali metal salt, preferably a sodium salt, of carboxymethyl cellulose (CMC) having an average degree of substitution (DS) by carboxymethyl groups, determined in accordance with ASTM D 1439-03/method B, in a range of more than 0.4 to 1.5, preferably in a range of 0.6 to 1.1, preferably in a range of 0.7 to 0.9, carboxymethyl groups per anhydroglucose unit.

Suitable commercially available, preferably water-soluble, binders are, for example, the sodium carboxymethyl celluloses Rheolon® 30, Rheolon® 30N, Rheolon® 100N or Rheolon® 300, Rheolon® 300N, Rheolon® 500G and Rheolon® 1000G, each available from Ugur Seluloz Kimya (Aydin, TR).

Further suitable commercially available binders are, for example, the carboxymethyl celluloses of the Calexis® and Finnfix® types, each of which may be acquired from CP Kelco Germany GmbH (Grossenbrode, Del.).

A substrate of the invention preferably comprises the at least one binder in a fraction in a range of 1 $g/m^2$ to 30 $g/m^2$, preferably in a range of 2 $g/m^2$ to 20 $g/m^2$, more preferably in a range of 1.3 $g/m^2$ to 17 $g/m^2$, more preferably in a range of 3.0 $g/m^2$ to 15 $g/m^2$, more preferably in a range of 3.5 $g/m^2$ to 13 $g/m^2$, more preferably in a range of 4 $g/m^2$ to 11 $g/m^2$, more preferably in a range of 4.5 $g/m^2$ to 9 $g/m^2$, based in each case on the area of the dry substrate.

In accordance with the invention the substrate of the invention comprises at least one, preferably water-soluble, amphoteric amine which together with the at least one binder preferably forms a poly salt and/or polymeric aggregate.

In accordance with the invention, the term "amphoteric amine" is understood to refer to an organic compound which comprises at least one, preferably protonatable and/or protonated, amino group, selected preferably from the group consisting of primary amino groups, secondary amino groups, tertiary amino groups and combinations thereof, preferably primary amino groups, secondary amino groups and combinations thereof, and at least one acid group, which preferably is at least one carboxyl group.

A suitable amphoteric amine preferably has at least one protonatable and/or protonated amino group. With further preference a suitable amphoteric amine may therefore, after protonation of the at least one amino group with anionically charged functional groups, for example deprotonated acid groups, of the at least one binder, form a poly salt, for example by electrostatic attraction of the residues of opposite charge.

With further preference an amphoteric amine in the sense of the invention comprises a first, preferably protonatable and/or protonated, amino group and a first acid group, preferably carboxyl group, and also, optionally, a second, preferably protonated and/or protonated, amino group, and/or a second acid group, preferably carboxyl group.

An amphoteric amine in the sense of the invention preferably has no permanently positively charged nitrogen atoms, more preferably no quaternary ammonium group, as for example tetraalkyl ammonium group.

Suitable amphoteric amines are preferably selected from the group consisting of amino carboxylic acids having preferably 2 to 36 carbon atoms, which may be unsubstituted or substituted, salts thereof, complexes thereof and mixtures thereof.

Suitable aminocarboxylic acids having preferably 2 to 36 carbon atoms, which may be unsubstituted or substituted, are organic compounds which preferably have at least one carboxyl group and at least one amino group. Suitable aminocarboxylic acids may preferably be substituted by chlorine, bromine, iodine, thiol groups, hydroxyl groups or combinations thereof.

Suitable aminocarboxylic acids are preferably alpha-aminocarboxylic acids. Suitable aminocarboxylic acids are selected with further preference from the group consisting of alanine, arginine, asparagine, aspartic acid, citrulline, cysteine, S-methylcysteine, cystine, creatine, homocysteine, homoserine, norleucine, 2-aminobutanoic acid, 2-amino-3-mercapto-3-methylbutanoic acid, 3-aminobutanoic acid, 2-amino-3,3-dimethylbutanoic acid, 4-aminobutanoic acid, 2-amino-2-methylpropanoic acid, 2-amino-3-cyclohexylpropanoic acid, 3-aminopropanoic acid, 2,3-diaminopropanoic acid, 3-aminohexanoic acid, gamma-carboxyglutamic acid (3-aminopropane-1,1,3-tricarboxylic acid), glutamine, glutamic acid, glycine, histidine, hydroxyproline, p-hydroxyphenylglycine, isoleucine, isovaline, leucine, lysine, methionine, ornithine ((S)-(+)-2,5-diaminopentanoic acid), phenylalanine, proline, serine, threonine, tryptophan, tyrosine, valine, salts thereof, complexes thereof and mixtures thereof, preferably of alanine, arginine, glycine, proline, lysine, histidine, glutamine, glutamic acid, aspartic acid, ornithine, salts thereof, complexes thereof and mixtures thereof, more preferably of alanine, arginine, glycine, proline, lysine, ornithine, salts thereof, complexes thereof and mixtures thereof, more preferably arginine, lysine, ornithine, salts thereof, complexes thereof and mixtures thereof, more preferably alanine, glycine, proline, salts thereof, complexes thereof and mixtures thereof, more preferably histidine, glutamine, glutamic acid, aspartic acid, salts thereof, complexes thereof and mixtures thereof.

In the case of a further-preferred embodiment, the at least one amphoteric amine is selected from the group consisting of aforesaid aminocarboxylic acids having preferably 2 to 36 carbon atoms which may be unsubstituted or substituted by chlorine, bromine, iodine, thiol groups, hydroxyl groups or combinations thereof, and from salts thereof, complexes thereof and mixtures thereof.

Preferably it is possible for metal cations, more preferably polyvalent metal cations, more preferably $Ca^{2+}$, $Zn^{2+}$ and mixtures thereof, more preferably $Ca^{2+}$, to form salts and/or complexes with one of the above-stated aminocarboxylic acids.

With further preference, aforesaid amphoteric amines, preferably aforesaid aminocarboxylic acids, may be used as salts and/or complexes of polyvalent metal cations, more preferably $Ca^{2+}$, $Zn^{2+}$ and mixtures thereof, more preferably $Ca^{2+}$.

The inventors have established that by using at least one amphoteric amine, preferably at least one aminocarboxylic acid, and/or a salt thereof and/or a complex thereof, the controllable disintegrability of the substrate of the invention is improved.

The at least one amphoteric amine, preferably the at least one aminocarboxylic acid having preferably 2 to 36 carbon atoms which may be unsubstituted or substituted by chlorine, bromine, iodine, thiol groups, hydroxyl groups or combinations thereof, and/or a salt thereof and/or a complex thereof, together with the at least one acid group-containing residue, preferably carboxyl group-containing residue, of the at least one, preferably water-soluble, polysaccharide preferably forms a poly salt following application to a substrate of the invention.

The at least one amphoteric amine, preferably, more preferably the at least one aminocarboxylic acid, has a solubility in water at 25° C. of greater than 9 g/l water, more preferably of greater than 11 g/l water, more preferably of greater than 20 g/l water, the pH of the water being 7.0.

A substrate of the invention preferably comprises the at least one amphoteric amine, which is preferably selected from the group consisting of aforesaid aminocarboxylic acids having from preferably 2 to 36 carbon atoms, which may be unsubstituted or substituted, aforesaid aminosulfonic acids having preferably 1 to 36 carbon atoms which may be unsubstituted or substituted, salts thereof, complexes thereof and mixtures thereof, in a fraction in a range of 0.1% by weight to 30% by weight, preferably in a range of 0.5% by weight to 20% by weight, more preferably in a range of 0.7% by weight to 17% by weight, more preferably in a range of 2% by weight to 15% by weight, more preferably in a range of 3.3% by weight to 13% by weight, based in each case on the total weight of the dry substrate of the present invention.

A substrate of the invention further comprises at least one moistening agent, the at least one moistening agent comprising at least one organic component selected from aliphatic alcohols, aliphatic ethers, aliphatic esters, monosaccharides, oligosaccharides and mixtures thereof, preferably aliphatic alcohols, aliphatic ethers and mixtures thereof.

Under standard conditions (temperature 25° C., pressure 1013 mbar), the at least one moistening agent may be solid or liquid, preferably liquid.

The fibre-containing substrate preferably comprises a moistening agent which is liquid under standard conditions and is preferably aqueous, where the at least one organic component may be solid or liquid, preferably liquid, under standard conditions (temperature 25° C., pressure 1013 mbar). For example, an organic component which is solid under standard conditions may be present in solution and/or dispersion in a moistening agent which is liquid under standard conditions.

The at least one organic component is selected in accordance with the invention from the group consisting of aliphatic alcohols, aliphatic ethers, aliphatic esters, monosaccharides, oligosaccharides and mixtures thereof, preferably aliphatic alcohols, aliphatic ethers and mixtures thereof.

Suitable aliphatic alcohols may be acyclic or cyclic and also saturated or unsaturated. Suitable aliphatic alcohols are preferably saturated, more preferably acyclic and saturated.

Suitable aliphatic alcohols have preferably 1 to 12 carbon atoms, more preferably 1 to 9 carbon atoms, more preferably 1 to 6 carbon atoms, more preferably 1 to 4 carbon atoms, more preferably 2 to 3 carbon atoms, which may in each case be straight-chain or branched, and at least one OH group, preferably 1 to 12 OH groups, more particularly 1 to 9 OH groups, more preferably 1 to 6 OH groups, more preferably 1 to 4 OH groups, more preferably 2 to 3 OH groups.

Suitable aliphatic alcohols are selected more preferably from the group consisting of aliphatic monohydric alcohols having 1 to 12 carbon atoms, more preferably 1 to 9 carbon atoms, more preferably 1 to 6 carbon atoms, more preferably 1 to 4 carbon atoms, more preferably 2 to 3 carbon atoms, which may in each case be straight-chain or branched, and have 1 OH group; aliphatic polyhydric alcohols having 2 to 12 carbon atoms, more preferably 2 to 9 carbon atoms, more preferably 2 to 6 carbon atoms, more preferably 2 to 4 carbon atoms, more preferably 2 to 3 carbon atoms, which may in each case be straight-chain or branched, and have 2 to 12 OH groups, more preferably 2 to 9 OH groups, more preferably 2 to 6 OH groups, more preferably 2 to 4 OH groups, more preferably 2 to 3 OH groups; and mixtures thereof.

Suitable aliphatic monohydric alcohols have 1 OH group and 1 to 12 carbon atoms, more preferably 1 to 9 carbon atoms, more preferably 1 to 6 carbon atoms, more preferably 1 to 4 carbon atoms, more preferably 2 to 3 carbon atoms, which may in each case be straight-chain or branched, and are selected preferably from the group consisting of methanol, ethanol, 1-propanol, 2-propanol, 1-butanol, 2-butanol, 2-methyl-1-propanol, 2-methyl-2-propanol, 1-pentanol, 2-pentanol, 3-pentanol, 2-methyl-1-butanol, 2-methyl-2-butanol, 3-methyl-1-butanol, 3-methyl-2-butanol, 2,2-dimethyl-1-propanol, 1-hexanol, 1-heptanol, and mixtures thereof, more preferably methanol, ethanol, 1-propanol, 2-propanol, 1-butanol, 2-butanol, 2-methyl-1-propanol, 2-methyl-2-propanol and mixtures thereof.

Aliphatic polyhydric alcohols are preferably selected from the group consisting of alkanediols having 2 to 12 carbon atoms, more preferably 2 to 9 carbon atoms, more preferably 2 to 6 carbon atoms, more preferably 2 to 4 carbon atoms, more preferably 2 to 3 carbon atoms, which may in each case be straight-chain or branched, alkanetriols having 3 to 12 carbon atoms, more preferably 3 to 9 carbon atoms, more preferably 3 to 6 carbon atoms, more preferably 3 to 4 carbon atoms, which may in each case be straight-chain or branched, alkanetetraols having 4 to 12 carbon atoms, more preferably 4 to 9 carbon atoms, more preferably 4 to 6 carbon atoms, which may in each case be straight-chain or branched, alkanepentaols having 5 to 12 carbon atoms, more preferably 5 to 9 carbon atoms, more preferably 5 to 6 carbon atoms, which may in each case be straight-chain or branched, alkanehexaols having 6 to 12 carbon atoms, more preferably 6 to 9 carbon atoms, which may in each case be straight-chain or branched, and mixtures thereof.

Suitable aliphatic polyhydric alcohols are preferably selected from the group consisting of ethane-1,2-diol (ethylene glycol, 1,2-glycol), propane-1,2-diol (propylene glycol), propan-1,3-diol (trimethylene glycol), butane-1,2-diol (1,2-butylene glycol), butane-1,3-diol (1,3-butylene glycol), butane-1,4-diol (tetramethylene glycol), butane-2,3-diol (2,3-butylene glycol), pentane-1,5-diol (pentamethylene glycol), hexane-1,6-diol (hexamethylene glycol), octane-1,8-diol (octamethylene glycol), nonane-1,9-diol (nonamethylene glycol), decane-1,10-diol (decamethylene glycol), 1,2,3-propanetriol (glycerol), 1,2,6-hexanetriol, 1,2,3,4-butanetetraol, 1,2,3,4,5,6-hexanehexaol (sorbitol) or mixtures thereof, more preferably ethane-1,2-diol, propane-1,2-diol, propane-1,3-diol, butane-1,2-diol, butane-1,3-diol, butane-1,4-diol, butane-2,3-diol, pentane-1,5-diol, hexane-1,6-diol (hexamethylene glycol), octane-1,8-diol (octamethylene glycol), nonane-1,9-diol (nonamethylene glycol) or mixtures thereof, more preferably ethane-1,2-diol, propane-1,2-diol, propane-1,3-diol, butane-1,2-diol, butane-1,3-diol, butane-1,4-diol, butane-2,3-diol, 1,2,3-propanetriol, 1,2,3,4-butantetraol, or mixtures thereof, more preferably ethane-1,2-diol, propane-1,2-diol, propane-1,3-diol or mixtures thereof.

Suitable aliphatic ethers are preferably ethers of polyhydric aliphatic alcohols; suitable aliphatic ethers are more preferably glycol ethers, polyethers of polyhydric aliphatic alcohols or mixtures thereof.

Polyethers of polyhydric aliphatic alcohols are preferably polyethers of aforesaid polyhydric aliphatic alcohols, more preferably of aforesaid alkanediols.

Suitable polyethers have preferably 4 to 40 carbon atoms and at least 2 OH groups, preferably 2 OH groups, and are preferably selected from the group consisting of polyethylene glycols having 4 to 40 carbon atoms, polypropylene glycol having 6 to 40 carbon atoms and mixtures thereof, more preferably from polyethylene glycols having 4 to 40 carbon atoms and mixtures thereof.

Suitable polyethylene glycols having 4 to 40 carbon atoms, which may preferably be straight-chain or branched, are, for example, 2-(2-hydroxyethoxy)ethanol (diethylene glycol), 2-[2-(2-hydroxyethoxy)ethoxy]ethanol (triethylene glycol), PEG-4, PEG-6, PEG-7, PEG-8, PEG-9, PEG-10, PEG-12, PEG-14, PEG-16, PEG-18, PEG-20 or mixtures thereof.

A suitable polypropylene glycol having 6 to 40 carbon atoms, which may preferably be straight-chain or branched, is, for example dipropylene glycol, which preferably is a mixture of the structural isomers 2,2'-oxydi-1-propanol, 1,1'-oxydi-2-propanol and 2-(2-hydroxypropoxy)-1-propanol.

Suitable glycol ethers have preferably 3 to 80 carbon atoms and are ethers of aforesaid alkanediols having 2 to 12 carbon atoms, which may in each case be straight-chain or branched, aforesaid polyethylene glycols having 4 to 40 carbon atoms, which may be straight-chain or branched, aforesaid polypropylene glycols having 6 to 40 carbon atoms, which may be straight-chain or branched, or combinations thereof with aforesaid aliphatic monohydric alcohols.

Suitable glycol ethers are selected preferably from the group consisting of ethylene glycol monomethyl ether (methyl glycol), ethylene glycol monoethyl ether (ethyl glycol), ethylene glycol monopropyl ether (2-propoxyethanol), ethylene glycol monoisopropyl ether (2-isopropoxyethanol), ethylene glycol monobutyl ether (2-butoxyethanol), ethylene glycol monohexyl ether (2-hexoxyethanol), diethylene glycol monomethyl ether, diethylene glycol monoethyl ether, diethylene glycol mono-n-butyl ether, diethylene glycol mono-n-hexyl ether, propylene glycol monomethyl ether (1-methoxy-2-propanol), propylene glycol monobutyl ether (1-butoxy-2-propanol), propylene glycol monohexyl ether (1-hexoxy-2-propanol), dipropylene glycol monomethyl ether, dipropylene glycol monobutyl ether, dipropylene glycol monohexyl ether, polyethylene glycol ether, polypropylene glycol ether, ethylene glycol dimethyl ether (dimethoxyethane), ethylene glycol diethyl ether (diethyl glycol), ethylene glycol dibutyl ether (dibutoxyethane), dipropylene glycol dimethyl ether and mixtures thereof.

Monosaccharides in the sense of the invention have preferably 3 to 9 carbon atoms, including 1 carbonyl group [C(=O)], which is in the form of an aldehyde group or keto group, and also at least two hydroxyl groups (OH groups). Monosaccharides in the sense of the invention are more preferably selected from the group consisting of polyhydroxyaldehydes (aldoses) of the general formula (I):

$$H—[CH(OH)]_n—C(=O)H \quad (I)$$

and also cyclic hemiacetals derived therefrom, polyhydroxyketones (ketoses) of the general formula (II):

$$H—[CH(OH)]_a—C(=O)—[CH(OH)]_b—H \quad (II)$$

and also cyclic hemiacetals derived therefrom, and mixtures thereof, where n in each case independently of any other denotes an integer from 2 to 8 and where a and b in each case independently of one another denote an integer from 1 to 7, with the proviso that a+b is an integer in a range of 2 to 8.

Cyclic hemiacetals (lactols) of aforesaid aldoses and ketoses come about preferably through intramolecular hemiacetalization between the carbonyl group and an OH group of a monosaccharide.

Oligosaccharides in the sense of the invention have preferably 8 to 40 carbon atoms and are constructed preferably of 2 to 9, preferably 2 to 6, identical or different monosaccharides, each joined to one another by glycosidic bonds. Oligosaccharides in the sense of the invention may be straight-chain or branched.

Suitable glycol esters have preferably 3 to 60 carbon atoms and are preferably monoesters, diesters or mixtures thereof of aforesaid alkanediols, aforesaid polyethylene glycols, aforesaid polypropylene glycols, or combinations thereof with aliphatic carboxylic acids, for example monocarboxylic acids with preferably 1 to 9 carbon atoms, preferably 1 to 7 carbon atoms, preferably 1 to 3 carbon atoms, which may in each case be straight-chain or branched, hydroxycarboxylic acids with preferably 1 to 9 carbon atoms, preferably 1 to 7 carbon atoms, preferably 1 to 3 carbon atoms, which may in each case be straight-chain or branched, polycarboxylic acids with preferably 2 to 9 carbon atoms, preferably 2 to 7 carbon atoms, preferably 2 to 3 carbon atoms, which may in each case be straight-chain or branched, or combinations thereof, more preferably hydroxycarboxylic acids with preferably 1 to 9 carbon atoms, preferably 1 to 7 carbon atoms, preferably 1 to 3 carbon atoms, which may in each case be straight-chain or branched, polycarboxylic acids with preferably 2 to 9 carbon atoms, preferably 2 to 7 carbon atoms, preferably 2 to 3 carbon atoms, which may in each case be straight-chain or branched, or combinations thereof.

Examples of suitable glycol esters are acetic acid ethylene glycol methyl ether ester (2-methoxyethyl acetate), acetic acid ethylene glycol monethyl ether ester (2-ethoxyethyl acetate), acetic acid ethylene glycol monobutyl ether ester (2-butoxyethyl acetate), acetic acid diethylene glycol monobutyl ether ester [2-(2-butoxyethoxy)ethyl acetate], acetic acid propylene glycol methyl ether ester (1-methoxy-2-propyl acetate) or mixtures thereof.

The at least one organic component is preferably selected from the group consisting of aliphatic monohydric alcohols, aliphatic polyhydric alcohols, polyethylene glycols and mixtures thereof.

With further preference the at least one organic component is selected from the group consisting of methanol, ethanol, 1-propanol, 2-propanol, 1-butanol, 2-butanol, 2-methyl-1-propanol, 2-methyl-2-propanol, 1-pentanol, 2-pentanol, 3-pentanol, 2-methyl-1-butanol, 2-methyl-2-butanol, 3-methyl-1-butanol, 3-methyl-2-butanol, 2,2-dimethyl-1-propanol, 1-hexanol, ethane-1,2-diol, propane-1,2-diol, propane-1,3-diol, butane-1,2-diol, butane-1,3-diol, butane-1,4-diol, butane-2,3-diol, 1,2,3-propanetriol, 1,2,3,4-butanetetraol, 1,2,6-hexanetriol, 1,2,3,4,5,6-hexanehexol, 2-(2-hydroxyethoxy)ethanol, 2-[2-(2-hydroxyethoxy)ethoxy]ethanol, PEG-4, PEG-6, PEG-7, PEG-8, PEG-9, PEG-10, PEG-12, PEG-14, PEG-16, PEG-18, PEG-20 and mixtures thereof, more preferably methanol, ethanol, 1-propanol, 2-propanol, 1-butanol, 2-butanol, 2-methyl-1-propanol, 2-methyl-2-propanol, ethane-1,2-diol, propane-1,2-diol, propane-1,3-diol, butane-1,2-diol, butane-1,3-diol, butane-1,4-diol, butane-2,3-diol, 1,2,3-propanetriol, 1,2,3,4-butanetetraol, 1,2,3-propanetriol and mixtures thereof, more preferably ethanol, 1-propanol, 2-propanol, ethane-1,2-diol, propane-1,2-diol, propane-1,3-diol, 1,2,3-propanetriol and mixtures thereof, more preferably ethanol, 1-propanol, 2-propanol, ethane-1,2-diol, propane-1,2-diol, propane-1,3-diol and mixtures thereof.

According to one preferred variant, the moistening agent consists of ethanol, 1-propanol, 2-propanol, ethane-1,2-diol, propane-1,2-diol, propane-1,3-diol, 1,2,3-propanetriol or mixtures thereof, more preferably from ethanol, 1-propanol, 2-propanol, ethane-1,2-diol, propane-1,2-diol, propane-1,3-diol or mixtures thereof.

The moistening agent preferably comprises the at least one organic component in a fraction of at least 5% by weight, preferably in a range of 6% by weight to 98% by weight, preferably in a range of 8% by weight to 95% by weight, more preferably in a range of 10% by weight to 85% by weight, more preferably in a range of 12% by weight to 65% by weight, more preferably in a range of 17% by weight to 55% by weight, based in each case on the total weight of the moistening agent.

With further preference the moistening agent comprises water in a fraction of at most 70% by weight, preferably in a range of 2% by weight to 65% by weight, more preferably in a range of 5% by weight to 60% by weight, more preferably in a range of 7% by weight to 57% by weight, more preferably in a range of 9% by weight to 45% by weight, more preferably in a range of 10% by weight to 30% by weight, based in each case on the total weight of the moistening agent.

With further preference the moistening agent comprises non-aqueous constituents, i.e. all constituents of the moistening agent that are not water, in a fraction of at least 30% by weight, preferably in a range of 35% by weight to 98% by weight, more preferably in a range of 40% by weight to 93% by weight, more preferably in a range of 55% by weight to 92% by weight, more preferably in a range of 70% by weight to 90% by weight, based in each case on the total weight of the moistening agent.

The term "lotion" is understood preferably to refer to a liquid or aqueous or aqueous-organic, preferably aqueous-alcoholic, preparation or to an oil-in-water emulsion or a water-in-oil emulsion.

The at least one moistening agent may under standard conditions (temperature 25° C., pressure 1013 mbar) take the form of a lotion, in which case the at least one organic component selected from the group consisting of aliphatic alcohols, aliphatic ethers, aliphatic esters, monosaccharides, oligosaccharides and mixtures thereof, preferably aliphatic alcohols, aliphatic ethers and mixtures thereof, may be present, for example, in solution in the lotion and/or may form an organic phase of the lotion.

In a further-preferred embodiment, the substrate of the invention comprises the at least one, preferably liquid, preferably aqueous moistening agent in the form, for example, of a lotion, with a pH of less than or equal to 6.4, preferably with a pH of less than or equal to 6.1, preferably with a pH of less than or equal to 5.9.

According to one preferred variant, the pH of the at least one, preferably liquid, preferably aqueous moistening agent is in a range of pH 4.0 to 6.4, preferably in a range of pH 4.5 to 6.1, preferably in a range of pH 4.9 to 5.9, preferably in a range of pH 5.0 to 5.6.

In the case of a further preferred embodiment, the substrate of the invention comprises the at least one binder in a fraction in a range of 1% by weight to 35% by weight, preferably 3% by weight to 30% by weight, more preferably of 4% by weight to 25% by weight, more preferably of 5% by weight to 20% by weight, more preferably of 6% by weight to 15% by weight, more preferably of 7% by weight to 13% by weight, based in each case on the total weight of the dry substrate of the invention.

The substrate of the invention preferably comprises inorganic and/or organic fibres. A fibre is preferably an organic or inorganic structure of limited length, with a ratio of length to diameter of at least 5:1 to 10:1.

The substrate of the invention preferably comprises fibres with a length of at least 0.1 mm, preferably in a range of 0.1 mm up to and including 10 mm, more preferably in a range of from 0.2 to 6 mm, more preferably in a range of from 1 mm to 4 mm, more preferably in a range of from 1.1 to 3 mm, these fibres being preferably dispersible and/or soluble in water.

Suitable organic fibres may be either natural fibres or synthetic fibres and also blends thereof. A substrate of the invention preferably comprises only natural fibres, preferably cellulose fibres.

Suitable synthetic fibres comprise, for example, polyester fibres, polyamide fibres, polyimide fibres, polyamideimide fibres, polyethylene fibres, polypropylene fibres, polyvinyl chloride fibres or mixtures thereof, with suitable synthetic fibres having a length of at most 6 mm.

Suitable inorganic fibres comprise, for example, mineral wool fibres, basalt fibres, glass fibres, silica fibres, ceramic fibres, carbon fibres or mixtures thereof.

A substrate of the invention preferably has no fibres having a fibre length of more than 6 mm. After dissolution of the substrate of the invention in waste water, for example, the use of short fibres, i.e. of fibres whose length does not exceed 6 mm, prevents individual fibres intertangling and/or felting to form fibre assemblies. Fibre assemblies may remain suspended, for example, in a siphon or on a discharge screen, and lead to blockages.

In one preferred embodiment, cellulose fibres are primarily used. In addition it is possible for example to use rayon, cotton, wool, acetate or Tencel fibres, In a further preferred embodiment, the fibre-containing substrate comprises 40% to about 95% by weight, more preferably 60% to 90% by weight, of cellulose fibres, based in each case on the total weight of the dry, fibre-containing substrate of the invention.

The cellulose fibres used may be obtained by chemical digestion of plant fibres or by use of recycled fibres. It is possible with preference to use wood fibres, fibres from annual plants, such as, for example, straw, bagasse, kenaf or bamboo, and mixtures thereof. Furthermore, it is possible for example to use not only hardwood pulp but also softwood pulp; the nature and manner of the chemical digestion used is not critical per se.

The fibres used, preferably cellulose fibres, are joined to one another in accordance with the invention by means of at least one binder.

The at least one binder may be used preferably as an aqueous solution and/or as a binder foam.

A substrate of the invention preferably comprises at least one filler which preferably has a particle size of less than 1 mm and whose ratio of length to diameter is less than 5:1.

With further preference, the at least one filler comprises or consists of inorganic particles, organic particles or mixtures thereof which have a particle size of less than 1 mm, preferably less than 0.9 mm, and whose ratio of length to diameter is less than 5:1, more preferably less than 4:1.

Suitable organic fillers are preferably ground or comminuted fibres, precipitated polymers or precipitation polymers, which may have been synthesized in each case, for example, from polyamide, polyester, polyethylene, crosslinked polyacrylates, non-crosslinked polyacrylates, mixtures thereof or copolymers thereof.

Suitable organic fillers also preferably include fine particles of cellulose, regenerated cellulose and/or other natural fibres, flours, modified starches, unmodified starches or mixtures thereof.

Suitable inorganic fillers are preferably natural mineral powders, precipitated mineral salts or combinations thereof, comprising or consisting for example of dolomite, calcium carbonate, titanium dioxide, zinc oxide, aluminium oxide, aluminium hydroxide, precipitated silica, kaolin and other clays, silicatic minerals or combinations thereof.

Depending on application an amount, suitable fillers may preferably be incorporated into the substrate, or applied together with the binder, for example, to the surface of the substrate. By using suitable fillers, for example titanium dioxide particles, it is possible for example to adjust the opacity of the substrate.

In one preferred embodiment, a substrate of the invention comprises the at least one filler in a fraction in a range of 0 to 30% by weight, more preferably in a range of 0.1 to 25% by weight, based in each case on the total weight of the dry substrate.

The fillers used are more preferably bonded to the substrate by at least one binder.

In one preferred embodiment, the substrate of the invention comprises 1 to 4 layers, preferably 1 to 3 layers. With further preference the substrate of the invention is single-layered.

In a further preferred embodiment, the substrate of the invention has a plurality of layers, preferably 2, 3 or 4 layers, with none of this plurality of layers being impervious to aqueous media.

The substrate of the invention preferably has a weight per unit area in a range of 30 g/m$^2$ to 150 g/m$^2$, preferably of 40 g/m$^2$ to 80 g/m$^2$, preferably of 45 g/m$^2$ to 60 g/m$^2$.

A substrate of the invention is produced by a method which comprises the following step:

(a) providing a fibre-containing substrate comprising fibres and at least 1 binder, wherein the at least 1 binder comprises at least 1 polysaccharide having at least 1 acid group-containing residue, wherein furthermore, in and/or after step (a), at least 1 amphoteric amine and at least 1 moistening agent are added successively, together or simultaneously, wherein the at least one 1 moistening agent comprises at least 1 organic component, preferably water-binding organic component, selected from the group consisting of aliphatic alcohols, aliphatic ethers, aliphatic esters, monosaccharides, oligosaccharides and mixtures thereof, preferably aliphatic alcohols, aliphatic ethers and mixtures thereof.

The substrate of the invention is preferably in the form of a nonwoven or a nonwoven material. In another preferred embodiment, the fibres are converted into a fibre web by carding, wet laying, air laying, spunbonding or melt blowing. With particular preference the fibre web or nonwoven web is formed by the air laying process, also referred to as air laid process, in which largely all, preferably all, of the fibres are closely mixed. The airlaid web is preferably thereafter compressed or consolidated.

The substrate of the invention, present preferably in the form of a nonwoven or a nonwoven material, is produced preferably by a method which comprises the following steps:

(a1) providing fibres, (a2) laying the fibres on a receiving surface to give a fibre bed, (a3) consolidating the fibre bed to give a consolidated fibre bed, where in steps (a1) and/or (a2) and/or (a3) and/or between steps (a1), (a2) or (a3) and/or after step (c), at least 1 binder comprising at least one polysaccharide having at least 1 acid group-containing residue, preferably at least one carboxyl group-containing residue, at least 1 amphoteric amine and at least 1 moistening agent are added successively, together or simultaneously, wherein the at least 1 moistening agent comprises at least 1 organic component, preferably water-binding organic component, selected from the group consisting of aliphatic alcohols, aliphatic ethers, aliphatic esters, monosaccharides, oligosaccharides and mixtures thereof, preferably aliphatic alcohols, aliphatic ethers and mixtures thereof.

The fibre bed here may be consolidated by various methods known in the prior art, such as, for example, latex bonding, thermal bonding, hydrogen bonding or multi-bonding. The thickness of the substrate of the invention may optionally be adjusted by means of calendering.

In one preferred embodiment, the substrate of the invention has superficial depressions and/or elevations, which may have been generated by embossing, for example.

In a further preferred embodiment, in or after step (a3), at least one binder, at least one amphoteric amine and at least one moistening agent are applied.

With further preference, in step (a1) and/or during steps (a2) and/or (a3), at least one binder and at least one amphoteric amine in the form of aqueous solution and/or of foam are applied successively, together or simultaneously and are subsequently solidified at a temperature of greater than 100° C., preferably greater than 120° C., preferably greater than 150° C. The at least one moistening agent is preferably applied thereafter.

The at least one binder, the at least one amphoteric amine and the at least one moistening agent are preferably applied, each independently of one another, by pad application, foam application, and/or spraying.

Suitable methods of pad application, foam application and spraying are known in the prior art and can be used in the present invention.

The at least one binder, the at least one amphoteric amine and the at least one moistening agent may be applied separately from one another to in each case the same side or to different sides of the substrate of the invention.

The at least one binder, the at least one amphoteric amine and the at least one moistening agent here may be applied sequentially, with the sequence of application being variable, or simultaneously.

Preferably first of all the at least one binder can be applied to one side or to both sides of the substrate of the invention. After the at least one binder has set, the at least one amphoteric amine is preferably applied to one side or to both sides of the substrate of the invention, more preferably to that side or those sides of the substrate of the invention to which the at least one binder was previously applied.

The at least one binder, the at least one amphoteric amine and the at least one moistening agent may alternatively be applied in the form of a mixture to one side or to both sides of the substrate of the invention.

In a further preferred embodiment, the substrate of the invention comprises or consists of a cellulosic nonwoven, the cellulosic nonwoven comprising 60 to 99% by weight, preferably 65 to 97.5% by weight, of cellulose fibres having a length in a range of 0.1 mm to 10 mm, preferably of 0.2 mm to 6 mm, more preferably of 1 mm to 4 mm, more preferably of 1.1 to 3 mm, at least one of the above-specified binders in a fraction of 0.5 to 40% by weight, preferably in a fraction of 1 to 35% by weight, at least one of the above-specified amphoteric amines in a fraction of 0.1 to 20% by weight, preferably in a fraction of 1 to 15% by weight, and optionally at least one of the above-stated fillers in a fraction of 0 to 30% by weight, preferably in a fraction of 0.1 to 25% by weight, based in each case on the total weight of the dry substrate of the invention, and at least one moistening agent which comprises the above-specified at least one organic component, with the proviso that the sum total of the fractions of the at least one binder, of the at least one amphoteric amine, of the at least one filler and preferably non-volatile constituents of the at least one moistening agent is in a range of 1 to 40% by weight, preferably in a range of 2.5 to 35% by weight, based in each case on the total weight of the dry substrate of the invention.

In spite of its wet strength, the substrate of the invention exhibits sufficient water-disintegrability, i.e. low wetness strength, in order to disintegrate in the waste water.

The at least one, preferably aqueous, moistening agent preferably has a pH from a range of 4.0 to 6.0, preferably of 5.0 to 5.6, and is therefore pH-neutral with regard to the pH of healthy skin.

In a further preferred embodiment, the at least one, preferably liquid, more preferably aqueous, moistening agent further comprises at least one polyvalent metal cation.

The inventors have ascertained that by using at least one polyvalent metal cation, the poly salt and/or the polymeric aggregate formed by the at least one binder and the at least one amphoteric amine can be stabilized on or in the substrate of the invention when there is at least one organic component present in the at least one, preferably liquid, preferably aqueous moistening agent.

Consequently, following application of at least one, preferably liquid, preferably aqueous moistening agent, preferably lotion which further comprises at least one polyvalent metal cation, the substrate of the invention exhibits a significantly increased wet strength.

Suitable polyvalent metal cations are preferably selected from the group consisting of polyvalent ions of the transition metals, polyvalent ions of the metals of the 3rd and 4th main groups of the periodic table of the elements, ions of the alkaline earth metals and mixtures thereof.

The term "transition metals" is understood in accordance with the invention to refer to the chemical elements with the atomic numbers from 21 to 30, 39 to 48, 57 to 80 and 89 to 112. The atomic number indicates the position of a chemical element in the Periodic Table of the Elements.

The term "polyvalent metal cations" is understood in accordance with the invention to refer to metal cations which have a charge of +2 or more, preferably a charge of +2, +3 or +4, more preferably a charge of +2.

With further preference, suitable polyvalent metal cations are selected from the group consisting of $Fe^{3+}$, $Ca^{2+}$, $Zn^{2+}$, and mixtures thereof, more preferably $Ca^{2+}$, $Zn^{2+}$ and mixtures thereof, more preferably $Ca^{2+}$.

Suitable metal cations may be introduced, for example, in the form of water-soluble salts and/or complexes of the corresponding metal cations, preferably as hydrogen carbonate, chloride, acetate, lactate, tartrate, fumarate, as carboxylate and/or complex of one of the above-stated amino carboxylic acids or a mixture thereof, preferably as chloride, carboxylate and/or complex of one of the above-stated aminocarboxylic acids or a mixture thereof, of the corresponding metal cations, into the preferably aqueous solution, preferably lotion.

Processes for preparing suitable salts and/or complexes of amphoteric amines, preferably aminocarboxylic acids, and polyvalent metal cations, preferably $Ca^{2+}$, $Fe^{3+}$, $Zn^{2+}$ and mixtures thereof, more preferably $Ca^{2+}$, $Zn^{2+}$ and mixtures thereof, more preferably $Ca^{2+}$, are described for example in U.S. Pat. Nos. 5,631,031 and 4,830,716.

The at least one, preferably liquid, preferably aqueous moistening agent preferably comprises the at least one polyvalent metal cation in a fraction in a range of 0.1% by weight to 10% by weight, preferably in a range of 0.2% by weight to 9% by weight, more preferably in a range of 1% by weight to 8% by weight, more preferably in a range of 3% by weight to 6% by weight, based in each case on the total weight of the at least one moistening agent.

In one preferred embodiment the at least one, preferably aqueous, moistening agent comprises or consists of water, at least one of the above-specified organic components, optionally at least one of the above-specified amphoteric amines and optionally at least one of the above-specified polyvalent metal cations, wherein the fraction of water is at most 70% by weight, preferably in a range of 2% by weight to 65% by weight, more preferably in a range of 7% by weight to 60% by weight, more preferably in a range of 8% by weight to 45% by weight, more preferably in a range of 10% by weight to 30% by weight, based in each case on the total weight of the moistening agent, wherein the fraction of the at least one organic component is at least 5.0% by weight, preferably in a range of 5% by weight to 98% by weight, preferably in a range of 8% by weight to 95% by weight, more preferably in a range of 10% by weight to 85% by weight, based in each case on the total weight of the moistening agent, wherein the fraction of the at least one amphoteric amine is 0% by weight to 30% by weight, preferably in a range of 0.5% by weight to 20% by weight, more preferably in a range of 0.7% by weight to 17% by weight, more preferably in a range of 2% by weight to 15% by weight, more preferably in a range of 3.3% by weight to 13% by weight, based in each case on the total weight of the moistening agent, wherein the fraction of the at least one polyvalent metal cation is in a fraction in a range of 0% by weight to 10% by weight, preferably in a range of 0.2% by weight to 9% by weight, more preferably in a range of 1% by weight to 8% by weight, more preferably in a range of 3% by weight to 6% by weight, based in each case on the total weight of the at least one moistening agent, with the provision that the sum total of the weight fractions of the at least one organic component, of the at least one amphoteric amine and of the at least one polyvalent metal cation is at least 30% by weight, preferably in a range of 35% by weight to 98% by weight, more preferably in a range of 40% by weight to 93% by weight, more preferably in a range of 55% by weight to 92% by weight, more preferably in a range of 70% by weight to 90% by weight, based in each case on the total weight of the moistening agent.

The at least one moistening agent preferably comprises non-volatile constituents, which more preferably are selected from the group consisting of the above-specified polyvalent metal cations and salts thereof, the above-specified amphoteric amines and salts and/or complexes thereof, and also combinations of these.

Centres of chirality may be present, unless otherwise specified, in the R- or in the S-configuration. The invention relates both to the use of optically pure compounds, for example an L-amino acid or D-amino acid, and to stereoisomer mixtures, such as enantiomer mixtures and diastereomer mixtures, in any ratio. For example, one of the aforementioned aminocarboxylic acids may be used as L-aminocarboxylic acid, as D-aminocarboxylic acid or as a racemate (D,L-aminocarboxylic acid).

For example, 1,2,3,4-butanetetraol may be present as (2R,3R)-1,2,3,4-butanetetraol (D-threitol), (2S,3S)-1,2,3,4-butanetetraol (L-threitol), as a racemate of (2R,3R)- and (2S,3S)-1,2,3,4-butanetetraol (DL-threitol), as (2S,3R)-1,2,3,4-butanetetraol (meso-1,2,3,4-butanetetraol, erythritol) or as a mixture thereof.

In a further preferred embodiment, the at least one, preferably liquid, preferably aqueous moistening agent may take the form of a lotion.

The at least one, preferably liquid, preferably aqueous moistening agent, preferably lotion, preferably further comprises at least one preservative, which is able, for example, to impart protection from microorganisms during long-term storage. The preservative preferably provides antimicrobial activity, including antibacterial activity, antifungal activity or anti-yeast activity, or a combination thereof.

In a further preferred embodiment, a substrate of the invention further comprises active skin-protection and/or skin-healing and/or skin-care substances that give the skin an advantage above and beyond a mere sensory and/or cosmetic advantage.

In one preferred embodiment, for example, active skin care may be provided in the form of stimulation of skin regeneration, support of skin physiology, reinforcement of the barrier function of the skin. The pH of the skin surface is dependent on sweat secretion, bacterial flora and sebum composition. Depending on the region of the skin, the pH is between 4 and 6.4, and in the case of healthy skin is more particularly around 5.5.

A substrate of the invention is preferably a fabric, preferably a wipe, blanket, bag, cushion, pouch or sack.

A substrate of the invention takes the form, for example, of an envelope or surround which may be open, preferably at one end, or closed. An envelope or surround comprising a substrate of the invention preferably further encloses a deodorant composition and/or a fluid-absorbing composition, as for example one or more copolymers of acrylic acid and sodium acrylate (superabsorbents).

A substrate in the form of an envelope or surround may be, for example, a nappy, as for example a baby nappy.

A substrate of the invention is preferably a hygiene article, in particular a wet wipe, cleansing wipe, care wipe, hygiene wipe, or moist toilet paper.

The substrate of the present invention is used preferably as a hygiene article, in particular as wet wipe, care wipe, cleansing wipe, moist toilet paper or tissue.

A wet wipe may be designed, for example, for personal care, for instance as a cosmetic wipe or as a disinfectant wipe, or as a cloth wipe in the household sphere.

Alternatively, a substrate of the invention has at least one layer which is pervious to aqueous media.

A substrate of the invention is preferably in the form of a bag, for example, a substrate of the invention in the form of a bag, having at least one layer pervious to aqueous media, can be introduced into the soil together with a fertilizer located in the bag. Through existing soil moisture and/or rain, for example, nutrients in the fertilizer are able to pass through the at least one layer of the substrate of the invention that is pervious to aqueous media, into the surrounding soil.

The substrate of the invention is used preferably in agriculture and forestry and also in gardening, for example as a seed carrier, cultivating pot or plant bag.

A substrate of the present invention is preferably a seed carrier, cultivating pot or plant bag. Seed carriers, preferably seed strips or seed disks, consist of a substrate of the invention housing individual seed grains, preferably between two layers of a substrate of the invention.

Seed carriers allow flowers and vegetables to be sewn in geometric patterns without any need to consider the spacing of the seed grains. For example, a seed carrier can be introduced into earth and then wetted with water.

Cultivating pots or plant bags may be constructed, for example, of one or more layers of a substrate of the invention. For example, a cultivating pot or plant bag may additionally comprise earth and a plant.

The invention is elucidated below by means of examples, without being limited to these examples. The experiments and measurements described below were carried out, in the absence of any other conditions being stated, at a temperature of 25° C. (room temperature), a pressure of 1013 mbar and a relative humidity of 65%.

Solvents, amphoteric amines, especially amino acid, and salts used hereinafter are available commercially, as for example from Parchem—fine & specialty chemicals, Inc. (New Rochelle, N.Y., USA) or Sigma-Aldrich Chemie GmbH (Munich, Del.).

INVENTIVE EXAMPLE 1: AIRLAID NONWOVEN WITH CONTROLLABLE DISINTEGRABILITY

For the following experiments, a commercially available airlaid cellulose nonwoven with a total basis weight of around 50 g/m$^2$ was used, with the designation W4 from ASCUTEC Airlaid-Produktion GmbH & Co KG (Nuremburg, Del.). The paper weights of the respective nonwoven webs were determined prior to use on cut samples measuring 10×10 cm.

Commercially available carboxymethyl celluloses (CMC) were used as binders containing at least one polysaccharide with acid group-containing residue. Rheolon® 30, Rheolon® 300, Rheolon® 500G and Rheolon® 1000G were obtained from Ugur Seluloz Kimya A.S. (Aydin, TR). Calexis® HMB and Finnfix® 700 were obtained from CP Kelco Germany GmbH (Grossenbrode, Del.).

The carboxymethyl celluloses used had different dynamic viscosities. Prior to application of the binder, samples of the particular binder used were taken, and a measurement was made of the dynamic viscosity of a 2% by weight solution of the binder in water at 20° C.

The viscosity of a 2% by weight solution of the corresponding binder in water at 20° C. was determined by means of a Searle rotary viscometer of type Haake® Viscotester® 550 (Thermo Fisher Scientific Inc., Karlsruhe, Del.) with cylinder measuring facility, MV measuring cup, at a rotational speed of 2.55 s$^{-1}$. The 2% by weight solution of the corresponding binder in water that was used was prepared by dissolving 2 g of the binder with stirring in 100 g of distilled water at 20° C. in accordance with manufacturer specifications.

The nonwoven webs were each first sprayed on one side with a 5% by weight aqueous dispersion of one of the above-specified binders, containing at least one polysaccharide with acid group-containing residue, the stated percentage being based on the binder content of the dispersion used per 100 g of water. The 2% by weight solution of the corresponding binder in water that was used was prepared with stirring in distilled water in accordance with manufacturer specifications. The particular amount of the binder applied, based on the area of the nonwoven web after drying, is reported in Table 1 ("Amount applied").

After drying and removal of the binder by condensation at a temperature of 150° C. to 170° C., the nonwoven web produced was rolled up.

This was followed by measurement of the tensile values of the resulting nonwoven webs in the dry state. For this purpose, samples of the resultant nonwoven webs measuring 10×10 cm were measured at room temperature in a tensile test according to DIN 54540-8 by pulling in the machine direction. The tensile values reported below ("Tensile value, dry") represent the arithmetic mean of 10 measurements in each case. The results are summarized in Table 1.

TABLE 1

Comparison of the binders used and of the dry strengths achieved therewith

| Nonwoven No. | Binder Type | Binder Viscosity [mPa · s] | Binder Applied amount [g/m$^2$] | Tensile value, dry [N] |
|---|---|---|---|---|
| 1a | Rheolon 30 | 36 | 1.75 | 38.4 |
| 1b | Rheolon 300 | 303 | 1.69 | 38.7 |
| 1c | Calexis HMB | 520 | 1.91 | 67.5 |
| 1d | Finnfix 700 | 610 | 0.98 | 36.3 |
| 1e | Finnfix 700 | 623 | 1.29 | 62.5 |
| 1f | Rheolon 500 G | 630 | 1.42 | 31.7 |
| 1g | Rheolon 500 G | 660 | 1.72 | 43.0 |
| 1h | Rheolon 1000G | 960 | 1.35 | 30.6 |
| 1i | Rheolon 1000G | 945 | 1.54 | 36.2 |
| 1j | Rheolon 1000G | 1100 | 1.78 | 46.5 |

The tensile values of the resultant nonwoven web were also measured in the wet state. For this purpose, samples of the respectively resultant nonwoven webs measuring 10×10 cm were cut out, after drying and removal of the binder by condensation, and 11 ml of "Lotion 1" per sample were added. The composition of "Lotion 1" was as follows:

| Ingredient | Final concentration |
|---|---|
| L-Lysine | 5.9% by weight |
| $CaCl_2 \times 2\ H_2O$ | 4.2% by weight |
| 1,2-Propanediol | 31.9% by weight |
| Ethanol | 3.5% by weight |
| Water | 54.5% by weight |

The stated % by weight are based in each case on the total weight of the lotion.

Following incubation at room temperature for 60 minutes, the tensile values of the moistened samples were measured at room temperature in a tensile test in analogy to DIN 54540-8 by pulling in machine direction. The tensile values reported below ("Tensile value, wet") represent the arithmetic mean from 10 measurements in each case.

Furthermore, the dissolution behaviour of the samples, wetted with lotion 1, in distilled water was ascertained. For this purpose, the premoistened samples measuring 10×10 cm were placed into vessels containing 100 ml of distilled water, and then incubated with stirring until the sample was dissolved. Here it was possible to remove only fibres from the vessel, using tweezers. The measurement was conducted in each case at intervals of 5 s. The disintegration times ("Dissolution in water") reported in Table 2 represent the arithmetic mean from 10 measurements in each case.

TABLE 2

Comparison of the wet strengths and wetness strengths achieved after wetting with lotion 1

| Nonwoven No. | Lotion 1 Tensile value [N] | Lotion 1 Dissolution in water [s] |
|---|---|---|
| 1a | 10 | 30 |
| 1b | 15 | 35 |
| 1c | 15 | 50 |
| 1d | 7 | 10 |
| 1e | 11 | 25 |
| 1f | 13 | 20 |
| 1g | 14 | 40 |
| 1h | 11 | 10 |
| 1i | 13 | 40 |
| 1j | 15.4 | 45 |

Increasing application of binder leads to increasing dry strength of the resultant nonwoven material after drying and removal of the binder by condensation. Even small increases in the viscosity and/or in the chain length of the binder used lead to superproportional increases in strength for a comparable applied amount, particularly in the case of low molecular mass carboxymethyl celluloses.

INVENTIVE EXAMPLE 2

The nonwoven webs 1a, 1c, 1e and 1i produced in example 1 were further treated with different lotions having different water contents. For this purpose, samples of the respective nonwoven webs measuring 10×10 cm were cut out, after drying and removal of the binder by condensation, and 11 ml of various lotions 1 to 5 were added per sample. The composition of the lotions 1 to 5 used is shown in Table 3. The % by weight reported refer in each case to the total weight of the lotion.

After incubation at room temperature for 60 minutes, the tensile values of the wetted samples were measured at room temperature in a tensile test in analogy to DIN 54540-8 by pulling in machine direction. The tensile values reported below ("Tensile value, wet") represent the arithmetic mean from 10 measurements in each case.

TABLE 3

Wet strengths achieved on reduction of the water content of the lotion

| | Binder: Rheolon 1000G | Calexis HMB | Finnfix 700 | Rheolon 30 |
|---|---|---|---|---|
| Applied amount [g/m$^2$] | 1.54 | 1.91 | 1.29 | 1.75 |

| Lotion No. | Composition [% by weight]: L-Lysine | $CaCl_2 \times 2\ H_2O$ | 1,2-Propanediol | Ethanol | Water | Tensile value, wet [N] | | | |
|---|---|---|---|---|---|---|---|---|---|
| 5 | 3.9 | 2.8 | 21.3 | 2.3 | 69.7 | 2.5 | 3.4 | 2.2 | 1.2 |
| 1 | 5.9 | 4.2 | 31.9 | 3.5 | 54.5 | 13.0 | 15.7 | 11.0 | 10.0 |
| 2 | 5.9 | 4.7 | 35.4 | 3.9 | 50.1 | 17.4 | 16.1 | 9.8 | 15.2 |

TABLE 3-continued

| Wet strengths achieved on reduction of the water content of the lotion | | | | | | | | | |
|---|---|---|---|---|---|---|---|---|---|
| 3 | 6.5 | 5.2 | 39.0 | 4.3 | 45.0 | 19.0 | 19.6 | 14.0 | 11.0 |
| 4 | 7.1 | 5.7 | 42.6 | 4.7 | 39.9 | 18.8 | 19.1 | 15.9 | 15.0 |

A reduction in the fraction of water in the lotion leads to an increase in the wet strength. The wet strength can be controlled over a wide range by measures including a change in the water content of the lotion.

INVENTIVE EXAMPLE 3

The nonwoven webs 1a and 1e produced in example 1 were further treated with different lotions in which only the amphoteric amine was present in the lotion (Lotion 6) or the amphoteric amine was used as the calcium salt (Lotions 7 and 8). For this purpose, samples of the respective nonwoven webs measuring 10×10 cm were cut out, after drying and removal of the binder by condensation, and 11 ml of various lotions 6 to 8 were added per sample. The composition of the lotions 6 to 8 used is shown in Table 4. The % by weight reported refer in each case to the total weight of the lotion.

Prior to use in lotions 7 and 8, the calcium salt of L-lysine was produced by reacting the amount of L-lysine reported in Table 4 with the amount of $CaCl_2 \times 2 \times H_2O$ reported in Table 4, in distilled water, and added to the corresponding lotion.

After incubation at room temperature for 60 minutes, the tensile values of the wetted samples were measured at room temperature in a tensile test in analogy to DIN 54540-8 by pulling in machine direction. The tensile values reported below ("Tensile value, wet") represent the arithmetic mean from 10 measurements in each case.

TABLE 4

| Wet strength values when using lotions 6 to 8 | | | | | | | |
|---|---|---|---|---|---|---|---|
| | | | | | | Binders | |
| | | | | | | Finnfix 700 | Rheolon 30 |
| Applied amount [g/m$^2$] | | | | | | 1.29 | 1.75 |
| | Lotion Composition [% by weight] | | | | | Tensile value, wet [N] | |
| No. | L-Lysine | $CaCl_2 \times 2\ H_2O$ | 1,2-Propanediol | Ethanol | Water | | |
| 6 | 10.0 | — | 34.0 | 13.0 | 43.0 | 9.1 | 8.2 |
| 7 | 9.4 | 3.8 | 42.2 | 4.7 | 39.9 | 17.3 | 15.0 |
| 8 | 6.5 | 5.2 | 39.0 | 4.3 | 45.0 | 19.6 | 19.0 |

With a lotion containing only an amphoteric amine and no further polyvalent metal cations, it was also possible to achieve sufficient wet strength. In place of the polyvalent ions, the pH is adjusted using organic or inorganic acids, with the pH used being in a range of 4.0 to 5.5.

When a calcium salt of the corresponding amphoteric amine was used in the lotion (Lotions 7 and 8), very good wet strengths were achieved.

INVENTIVE EXAMPLE 4

The lotions 1 to 8 used contained L-lysine as amphoteric amine. To investigate the effect of other amphoteric amines on the wet strength, further nonwoven webs were produced. For that purpose, a commercially available airlaid cellulosic nonwoven was likewise used, having a total basis weight of around 50 g/m$^2$, with the designation W4 from ASCUTEC Airlaid-Produktion GmbH & Co KG (Nuremberg, Del.).

The binder used was Rheolon 1000G, which was sprayed onto both sides of the nonwoven web, in the form of a 4% by weight aqueous dispersion of the binder, the stated percentage being based on the binder content of the dispersion used per 1000 g of water. 1.75 g/m$^2$ of Rheolon 1000G was applied to each of the facing and reverse sides of the nonwoven web. The total application of binder to the nonwoven web was therefore 3.5 g/m$^2$ of Rheolon 1000G. After drying and removal of the binder by condensation at a temperature of 150° C. to 170° C., the nonwoven produced was rolled up.

This was followed by measurement of the tensile values of the resulting nonwoven webs in the dry state. For this purpose, samples of the resultant nonwoven webs measuring 10×10 cm were measured at room temperature in a tensile test according to DIN 54540-8 by pulling in the machine direction. The tensile values reported below ("Tensile value, dry") represent the arithmetic mean of 10 measurements in each case.

The tensile values of the resultant nonwoven web were also measured in the wet state. For this purpose, samples of the respectively resultant nonwoven webs measuring 10×10 cm were cut out, after drying and removal of the binder by condensation, the dry weight of the sample was determined and 11 ml of various lotions 9 to 30 were added per sample. The composition of lotions 9 to 30 used is shown in Table 5. The stated % by weight are based in each case on the total weight of the lotion.

TABLE 5

Composition of lotions 9 to 30

| Lotion No. | Amphoteric amine used | Lotion composition [% by weight] Amine | $CaCl_2 \times 2H_2O$ | 1,2-Propanediol | Ethanol | Water |
|---|---|---|---|---|---|---|
| 9 | Ca-L-Lysine | 4.9 | 0.25 | 45 | 8.6 | 41.25 |
| 10 | L-Proline | 5.3 | — | 45 | 8.5 | 41.2 |
| 11 | Ca-L-Proline | 5.1 | 1.8 | 34.3 | 5.1 | 53.7 |
| 12 | Ca-L-Ornithine | 5.0 | 1.8 | 34.4 | 5.1 | 53.7 |
| 13 | Ca-L-Arginine | 5.2 | 1.8 | 34.2 | 5.1 | 53.7 |
| 14 | Ca-L-Glycine | 5.1 | 1.8 | 31.9 | 7.5 | 53.7 |
| 15 | Ca-L-Alanine | 6.4 | 1.7 | 17.0 | 21.2 | 53.7 |
| 16 | Ca-L-Leucine | 7.5 | 2.0 | 21.7 | 15.1 | 53.7 |
| 17 | Ca-L-Histidine | 5.2 | 1.8 | 30.8 | 8.5 | 53.7 |
| 18 | Ca-L-Asparagine × H2O | 5.1 | 1.6 | 25.4 | 14.2 | 53.7 |
| 19 | Ca-L-Glutamine | 5.4 | 2.2 | 24.5 | 14.2 | 53.7 |
| 20 | Ca-L-Phenylalanine | 6.4 | 1.7 | 26.2 | 12.0 | 53.7 |
| 21 | Ca-L-Threonine, tech. | 5.0 | 1.9 | 29.4 | 10.0 | 53.7 |
| 22 | Ca-L-Methionine, tech. | 5.1 | 1.7 | 29.3 | 10.2 | 53.7 |
| 23 | Ca-L-Tryptophan, tech. | 5.4 | 1.8 | 29.6 | 9.5 | 53.7 |
| 24 | Ca-L-Valine | 6.4 | 1.8 | 25.1 | 13.0 | 53.7 |
| 25 | Ca-L-Aspartic acid | 7.5 | 2.5 | 27.3 | 9.0 | 53.7 |
| 26 | Ca-L-Glutamic acid | 6.4 | 2.5 | 27.9 | 9.5 | 53.7 |
| 27 | Ca-L-Cysteine | 5.0 | 1.9 | 28.4 | 11.0 | 53.7 |
| 28 | Ca-L-Dihydroxyphenylalanine | 5.4 | 1.9 | 26.0 | 13.0 | 53.7 |
| 29 | Ca-L-Isoleucine | 5.2 | 1.7 | 27.4 | 12.0 | 53.7 |
| 30 | Ca-L-Serine | 5.1 | 1.8 | 31.9 | 7.5 | 53.7 |

The amphoteric amines labelled with "Ca-" in Table 5 were used in the form of the calcium salt of the corresponding L-amino acid. Prior to use in the corresponding lotion, the amount of the amphoteric amine reported in Table 5 was first dissolved in distilled water together with the amount of $CaCl_2 \times 2 \times H_2O$ reported in Table 5, and this solution was added to the corresponding lotion.

The tensile values of the nonwoven webs produced, in the dry state and after wetting with lotions 9 to 30, are summarized in Table 6.

Additionally, a determination was made of the disintegration time in water in analogy to the EDANA Test FG502 ("Slosh Box Disintegration Test") (EDANA=European Disposables and Nonwovens Association) at 20° C. on 10 samples in each case.

For this purpose, the wetted samples were each placed in a test vessel containing 2 l of mains water (temperature: 20° C., total hardness: 13.5° dH [German hardness], conductivity at 20° C.: 412 μS/cm, pH: 7.5) and incubated without stirring. The disintegration time was determined by visual inspection. The disintegration times reported in Table 6 represent the arithmetic mean from 10 measurements in each case.

Following their disintegration, the samples were incubated in the test vessel at 20° C. without stirring for a total of 3 hours in each case, after which they were passed through a perforated sieve (mesh size: 12.5 mm). The material remaining on the sieve was collected, dried and weighed.

Since less than 10% by weight, based on the dry weight of the sample as determined beforehand in each case, remained on the sieve for each of the samples tested, the EDANA test was rated as a pass for each of the solutions investigated.

The results of the disintegration test in water are likewise summarized in Table 6.

TABLE 6

Dry strength values and wet strength values of nonwoven webs impregnated with lotions 9 to 30

| Lotion No. | Tensile value, dry [N] | Tensile value, wet [N] | Disintegration in water [s] |
|---|---|---|---|
| 9 | 48 | 8.6 | 20 |
| 10 | 50 | 8.5 | <10 |
| 11 | 54 | 14.6 | 35 |
| 12 | 54 | 12 | 25 |
| 13 | 54 | 12 | 25 |
| 14 | 54 | 8.5 | <10 |
| 15 | 54 | 13.2 | 25 |
| 16 | 48 | 11 | 35 |
| 17 | 51 | 9 | 40 |
| 18 | 54 | 12 | 20 |
| 19 | 55 | 12 | 20 |
| 20 | 48 | 13 | 40 |
| 21 | 48 | 8 | 30 |
| 22 | 55 | 9.5 | 35 |
| 23 | 49 | 9 | 25 |
| 24 | 54 | 11 | 30 |
| 25 | 49 | 8.5 | 15 |
| 26 | 47 | 8.1 | <10 |
| 27 | 54 | 10.5 | 25 |
| 28 | 52 | 11 | 40 |
| 29 | 55 | 11.5 | 35 |
| 30 | 48 | 9.6 | 30 |

The wet strengths achieved for the samples impregnated with lotions 10 to 30 are analogous, with fluctuations, to those of lysine (Lotion 9).

COMPARATIVE EXAMPLE 5

In analogy to the cleaning sheet described in EP 0 372 388 A2, the nonwoven webs 1a and 1e produced in examples 1 were treated with lotions containing no amphoteric amine. For this purpose, samples of the respective nonwoven webs measuring 10×10 cm were cut out, after drying and removal of the binder by condensation, and 11 ml of different lotions 31 and 32 were added per sample. The composition of the lotions 31 and 32 used is shown in Table 7. The reported % by weight are based in each case on the total weight of the lotion.

After incubation at room temperature for 60 minutes, the tensile values of the wetted samples were measured at room temperature in a tensile test in analogy to DIN 54540-8 by pulling in machine direction. The tensile values reported below ("Tensile value, wet") represent the arithmetic mean from 10 measurements in each case.

TABLE 7

Wet strength values when using lotions 31 and 32

| | | | Binders | | | | |
|---|---|---|---|---|---|---|---|
| | | | Finnfix 700 | | Rheolon 30 | | |
| Applied amount [g/m$^2$] | | | 1.29 | | 1.75 | | |
| | Lotion Composition [% by weight] | | | | | Tensile value, wet | |
| No. | Amphoteric amine | $CaCl_2 \times 2\ H_2O$ | 1,2-Propanediol | Ethanol | Water | [N] | |
| 31 | — | 2.2 | — | 22.8 | 75.0 | 5.2 | 6.3 |
| 32 | — | 2.2 | — | 10.0 | 87.8 | 3.7 | 0.8 |

The wet strengths achieved without use of an amphoteric amine, such as of an L-amino acid, for example, were significantly lower.

INVENTIVE EXAMPLE 6 AND COMPARATIVE EXAMPLE 7

To test the storage stability of the wetted samples in the presence and absence, respectively, of an amphoteric amine, the nonwoven webs 1a and 1e produced in examples 1 were treated with different lotions and then stored in the corresponding lotion for 30 days before the wet strength was measured.

For this purpose, samples of the respective non woven webs measuring 10×10 cm were cut out, after drying and removal of the binder by condensation, and 11 ml of the corresponding lotions 31 and 32 from comparative example 5 and also lotions 6, 7 and 8 from inventive example 3 were added per sample. The composition of the lotions used is shown in Table 8. The reported % by weight are based in each case on the total weight of the lotion.

After incubation at room temperature for 60 minutes, the tensile values of the wetted samples were measured at room temperature ("after 60 min") in a tensile test in analogy to DIN 54540-8 by pulling in the machine direction. Further samples were stored in the corresponding lotion for 30 days in closed vessels at room temperature (25° C.), before the tensile values of the wetted samples were measured at room temperature ("after 30 days") in a tensile test in analogy to DIN 54540-8 by pulling in machine direction. The tensile values reported below ("Tensile value, wet") represent the arithmetic mean from 10 measurements in each case.

TABLE 8

Comparison of the wet strengths after 30-day storage at room temperature

| | Binder | | | |
|---|---|---|---|---|
| | Finnfix 700 | Rheolon 30 | Finnfix 700 | Rheolon 30 |
| Applied amount [g/m$^2$] | 1.29 | 1.75 | 1.29 | 1.75 |

TABLE 8-continued

| Comparison of the wet strengths after 30-day storage at room temperature | | | | | | | | | |
|---|---|---|---|---|---|---|---|---|---|
| | Lotion Composition [% by weight] | | | | | after 60 min Tensile value, wet | | after 30 days Tensile value, wet | |
| No. | Lysine | $CaCl_2 \times 2\ H_2O$ | 1,2-Propanediol | Ethanol | Water | [N] | | [N] | |
| 31 | — | 2.2 | — | 22.8 | 75.0 | 5.2 | 6.3 | 1.5 | 1.1 |
| 32 | — | 2.2 | — | 10.7 | 87.8 | 3.7 | 0.8 | <1 | <1 |
| 6 | 10.0 | — | 34.0 | 13.0 | 43.0 | 9.1 | 8.2 | 9.0 | 8.8 |
| 7 | 9.4 | 3.8 | 42.2 | 4.7 | 39.9 | 17.3 | 15.0 | 18 | 16.2 |
| 8 | 6.5 | 5.2 | 39.0 | 4.3 | 45.0 | 19.6 | 19.0 | 19.5 | 19.2 |

The stability of the wet strength under the respective storage conditions was achieved only by lotions containing the amphoteric amine.

The systems without amphoteric amine, amino acid for example, were unsuitable for producing marketable products in this regard. Storage for just 30 days in each of the lotions 31 and 32 used resulted in a significant reduction in the wet strength, which made further use as moist toilet paper, for example, impossible.

In contrast to this, when using one of the lotions 6 to 8, no significant reduction in the wet strength after 30 days was found. As a result, when wet wipes are stored in the corresponding lotion, in a bulk pack, for example, by the end user for at least 30 days, there is no substantial decrease in the mechanical robustness of a wet wipe or moist toilet paper when used by the end user.

The invention claimed is:

1. Wet strength, fibre-containing substrate, wherein the substrate comprises fibres, at least 1 binder, a salt or complex of polyvalent metal cation with at least 1 amphoteric amine, which is a compound which may react both as Brønsted acid and as Brønsted base, and at least 1 moistening agent, wherein the at least 1 binder comprises at least 1 polysaccharide having at least 1 acid group-containing residue and wherein the at least 1 moistening agent comprises at least 1 organic component selected from the group consisting of aliphatic alcohols, aliphatic ethers, aliphatic esters, monosaccharides, oligosaccharides and mixtures thereof.

2. Wet strength, fibre-containing substrate according to claim 1, wherein the at least 1 polysaccharide of the at least 1 binder is selected from the group consisting of cellulose, starch, agarose, algin, alginate, chitin, pectin, gum arabic, xanthan gum, guaran and a mixture thereof.

3. Wet strength, fibre-containing substrate according to claim 1, wherein the at least 1 binder is selected from the group consisting of carboxyalkyl celluloses, carboxyalkyl alkyl celluloses, carboxyalkyl hydroxyalkyl celluloses and mixtures thereof, wherein the alkyl residue may be straight-chain or branched, each having 1 to 4 carbon atoms.

4. Wet strength, fibre-containing substrate according to claim 1, wherein the at least one binder comprises an alkali metal salt of carboxymethyl cellulose (CMC) having an average degree of substitution (DS) by carboxymethyl groups, determined in accordance with ASTM D 1439-03/method B, in a range of more than 0.4 to 1.5.

5. Wet strength, fibre-containing substrate according to claim 1, wherein the substrate comprises the at least 1 binder in a proportion in a range of 1% by weight to 35% by weight, based on the total weight of the dry substrate.

6. Wet strength, fibre-containing substrate according to claim 1, wherein the at least 1 amphoteric amine is selected from the group consisting of aminocarboxylic acids having preferably 2 to 36 carbon atoms, which may be unsubstituted or substituted, salts thereof, complexes thereof and mixtures thereof.

7. Wet strength, fibre-containing substrate according to claim 1, wherein the at least 1 amphoteric amine is selected from the group consisting of alanine, arginine, asparagine, aspartic acid, citrulline, cysteine, S-methylcysteine, cystine, creatine, homocysteine, homoserine, norleucine, 2-aminobutanoic acid, 2-amino-3-mercapto-3-methylbutanoic acid, 3-aminobutanoic acid, 2-amino-3,3-dimethylbutanoic acid, 4-aminobutanoic acid, 2-amino-2-methylpropanoic acid, 2-amino-3-cyclohexylpropanoic acid, 3-aminopropanoic acid, 2,3-diaminopropanoic acid, 3-aminohexanoic acid, gamma-carboxyglutamic acid (3-aminopropane-1,1,3-tricarboxylic acid), glutamine, glutamic acid, glycine, histidine, hydroxyproline, p-hydroxyphenylglycine, isoleucine, isovaline, leucine, lysine, methionine, ornithine ((S)-(+)-2,5-diaminopentanoic acid), phenylalanine, proline, serine, threonine, tryptophan, tyrosine, valine, salts thereof, complexes thereof and mixtures thereof.

8. Wet strength, fibre-containing substrate according to claim 1, wherein the substrate comprises the at least 1 amphoteric amine in a proportion in a range of 0.1% by weight to 30% by weight, based on the total weight of the dry substrate.

9. Wet strength, fibre-containing substrate according to claim 1, wherein the at least 1 moistening agent comprises the at least one organic component in a proportion of at least 5.0% by weight, based on the total weight of the at least 1 moistening agent.

10. Wet strength, fibre-containing substrate according to claim 1, wherein the at least 1 moistening agent comprises at least 1 organic component selected from the group consisting of methanol, ethanol, 1-propanol, 2-propanol, 1-butanol, 2-butanol, 2-methyl-1-propanol, 2-methyl-2-propanol, 1-pentanol, 2-pentanol, 3-pentanol, 2-methyl-1-butanol, 2-methyl-2-butanol, 3-methyl-1-butanol, 3-methyl-2-butanol, 2,2-dimethyl-1-propanol, 1-hexanol, ethane-1,2-diol, propane-1,2-diol, propane-1,3-diol, butane-1,2-diol, butane-1,3-diol, butane-1,4-diol, butane-2,3-diol, 1,2,3-propanetriol, 1,2,3,4-butanetetraol, 1,2,6-hexanetriol, 1,2,3,4,5,6-hexanehexol, 2-(2-hydroxyethoxy)ethanol, 2-[2-(2-hydroxyethoxy)ethoxy]ethanol, PEG-4, PEG-6, PEG-7, PEG-8, PEG-9, PEG-10, PEG-12, PEG-14, PEG-16, PEG-18, PEG-20 and mixtures thereof.

11. Wet strength, fibre-containing substrate according to claim 1, wherein the substrate is a fabric.

12. Wet strength, fibre-containing substrate according to claim 1, wherein the at least 1 moistening agent further comprises at least 1 polyvalent metal cation selected from the group consisting of polyvalent ions of the transition metals, polyvalent ions of the metals of the 3rd and 4th main groups of the Periodic Table of the Elements, ions of the alkaline earth metals and mixtures thereof.

13. Wet strength, fibre-containing substrate according to claim 1, wherein the at least 1 moistening agent further comprises at least 1 metal cation selected from the group consisting of $Ca_{2+}$, $Zn_{2+}$ and mixtures thereof.

14. Method for producing a wet strength, fibre-containing substrate according to claim 1, wherein the method comprises the following step:

(a) providing a fibre-containing substrate comprising fibres and the at least 1 binder, wherein furthermore, in and/or after step (a), the at least 1 amphoteric amine and the at least 1 moistening agent are added successively, together or simultaneously.

15. Use of a wet strength, fibre-containing substrate according to claim 1 as a hygiene article or as a wet wipe.

16. The wet strength, fibre containing substrate of claim 1, wherein the at least 1 acid group-containing residue is selected from the group consisting of carboxyl group-containing residues, phosphate-containing residues, phosphonic acid-containing residues and combinations thereof.

* * * * *